US010222722B2

(12) United States Patent
Yukimoto et al.

(10) Patent No.: US 10,222,722 B2
(45) Date of Patent: Mar. 5, 2019

(54) TONER STORING CONTAINER, IMAGE FORMING APPARATUS, AND METHOD FOR MANUFACTURING TONER STORING CONTAINER

(71) Applicant: KONICA MINOLTA, INC., Chiyoda-ku, Tokyo (JP)

(72) Inventors: Tomoyoshi Yukimoto, Nagoya (JP); Taisuke Minemura, Okazaki (JP); Masayuki Satou, Toyohashi (JP); Yoshiyuki Toso, Toyokawa (JP); Shoichi Yoshikawa, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/721,523

(22) Filed: Sep. 29, 2017

(65) Prior Publication Data

US 2018/0113398 A1 Apr. 26, 2018

(30) Foreign Application Priority Data

Oct. 21, 2016 (JP) ..... 2016-207239

(51) Int. Cl.
*G03G 15/08* (2006.01)

(52) U.S. Cl.
CPC ..... *G03G 15/0872* (2013.01); *G03G 15/0894* (2013.01); *G03G 15/0879* (2013.01)

(58) Field of Classification Search
USPC ..... 399/107, 110, 119, 120, 252, 258, 260, 399/262, 263
See application file for complete search history.

(56) References Cited

U.S. PATENT DOCUMENTS

| | | | | |
|---|---|---|---|---|
| 5,257,077 | A | 10/1993 | Peters et al. | |
| 5,758,235 | A * | 5/1998 | Kosuge | G03G 15/0126 399/227 |
| 9,229,422 | B2 * | 1/2016 | Yamamoto | G03G 21/1676 |
| 9,454,099 | B2 * | 9/2016 | Yamabe | G03G 15/0872 |
| 2007/0122205 | A1 | 5/2007 | Taguchi et al. | |
| 2007/0147900 | A1 | 6/2007 | Taguchi et al. | |
| 2007/0147902 | A1 | 6/2007 | Taguchi et al. | |
| 2007/0154243 | A1 | 7/2007 | Taguchi et al. | |
| 2007/0154244 | A1 | 7/2007 | Taguchi et al. | |
| 2007/0160393 | A1 | 7/2007 | Taguchi et al. | |
| 2007/0160394 | A1 | 7/2007 | Taguchi et al. | |
| 2007/0177886 | A1 | 8/2007 | Taguchi et al. | |
| 2011/0002713 | A1 | 1/2011 | Taguchi et al. | |
| 2011/0008075 | A1 | 1/2011 | Taguchi et al. | |
| 2011/0286771 | A1 | 11/2011 | Taguchi et al. | |

FOREIGN PATENT DOCUMENTS

| | | | |
|---|---|---|---|
| JP | 05281856 | A | 10/1993 |
| JP | 2007148320 | A | 6/2007 |
| JP | 2010117604 | A | 5/2010 |

* cited by examiner

*Primary Examiner* — Hoan Tran
(74) *Attorney, Agent, or Firm* — Holtz, Holtz & Volek PC

(57) ABSTRACT

A toner storing container stores toner and is provided attachable to and detachable from an image forming apparatus. The toner storing container includes: a container body that includes an opening, and an inner circumferential surface extending toward the opening around a center line extending in one direction; and a toner conveyer that is attached onto the inner circumferential surface of the container body. The toner conveyer projects inward from the inner circumferential surface as well as spirally extends in the one direction around the center line.

18 Claims, 24 Drawing Sheets

FIG. 7

| | COST EFFICIENCY | MOLDABILITY | FLEXIBILITY | ADHESIVENESS | CRACKING RESISTANCE |
|---|---|---|---|---|---|
| PET | | | ○ | | |
| HDPE | | | | | |
| LDPE | | ○ | | | |
| PS | | ○ | | | |
| PVC | ○ | ○ | ○ (PLASTICIZER ADDED) | | |
| PP | | ○ | | | ○ |
| SI | | | ○ | ○ | |
| PUR | | | ○ | ○ | |

TONER STORING CONTAINER, IMAGE FORMING APPARATUS, AND METHOD FOR MANUFACTURING TONER STORING CONTAINER

Japanese Patent Application No. 2016-207239 filed on Oct. 21, 2016, including description, claims, drawings, and abstract the entire disclosure is incorporated herein by reference in its entirety.

TECHNOLOGICAL FIELD

The present invention relates to a toner storing container, an image forming apparatus, and a method for manufacturing the toner storing container. More specifically, the present invention relates to a toner storing container to supply toner, an image forming apparatus to include the toner storing container, and a method for manufacturing the toner storing container.

BACKGROUND

An image forming apparatus represented by a multi-function peripheral (referred to as "MFP") uses toner to print on a sheet of paper. In order to supply toner to the MFP, the MFP is provided with a toner storing container which stores toner.

Japanese Patent Laid-Open No. 2010-117604 describes a developer replenishing container that replenishes an image forming apparatus with developer by rotating, the developer replenishing container including: a container body for storing developer, in which a spiral projection is formed inside by blow molding; a developer discharge opening that is formed at one end of the container body, has no spiral projection formed, and has a smaller diameter than the inside diameter of the container body; and a conveying member that rotates integrally with the container body, and conveys developer conveyed by the spiral projection in the container body, to the developer discharge opening, wherein the conveying member is inserted into the container body from the developer discharge opening at one end of the container body, is displaced toward the radially outside of the container body within the container body after the insertion, and thus being fixed inside the container body.

However, according to the developer replenishing container described in Japanese Patent Laid-Open No. 2010-117604, in the case where an amount of toner to be contained is decreased, variation occurs in an amount of toner conveyed by the spiral projection, and thus it prevents stably supplying toner to a developing device.

SUMMARY

According to an aspect of the present invention, a toner storing container stores toner and is provided attachable to and detachable from an image forming apparatus. The toner storing container includes: a container body that includes an opening, and an inner circumferential surface extending toward the opening around a center line extending in one direction; and a toner conveyer that is attached onto the inner circumferential surface of the container body. The toner conveyer projects inward from the inner circumferential surface as well as spirally extends in the one direction around the center line.

According to another aspect of the present invention, an image forming apparatus includes the toner storing container mentioned above.

According to a further aspect of the present invention, a method for manufacturing the toner storing container is a method for manufacturing a toner storing container that stores toner and is provided attachable to and detachable from an image forming apparatus. The method includes: an attaching step of attaching a toner conveyer onto a container body wherein the container body includes an opening and an inner circumferential surface extending toward the opening around a center line extending in one direction, and the toner conveyer is attached onto an inner circumferential surface of a container body so as to project inward from the inner circumferential surface of the container body as well as spirally extends in the one direction around the center line; and a filling step of filling toner into the container body.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

FIG. 7 is a diagram showing an example of materials for the toner conveyer and characteristics thereof;

DETAILED DESCRIPTION OF EMBODIMENTS

Description of the Preferred Embodiments

Figure 1:
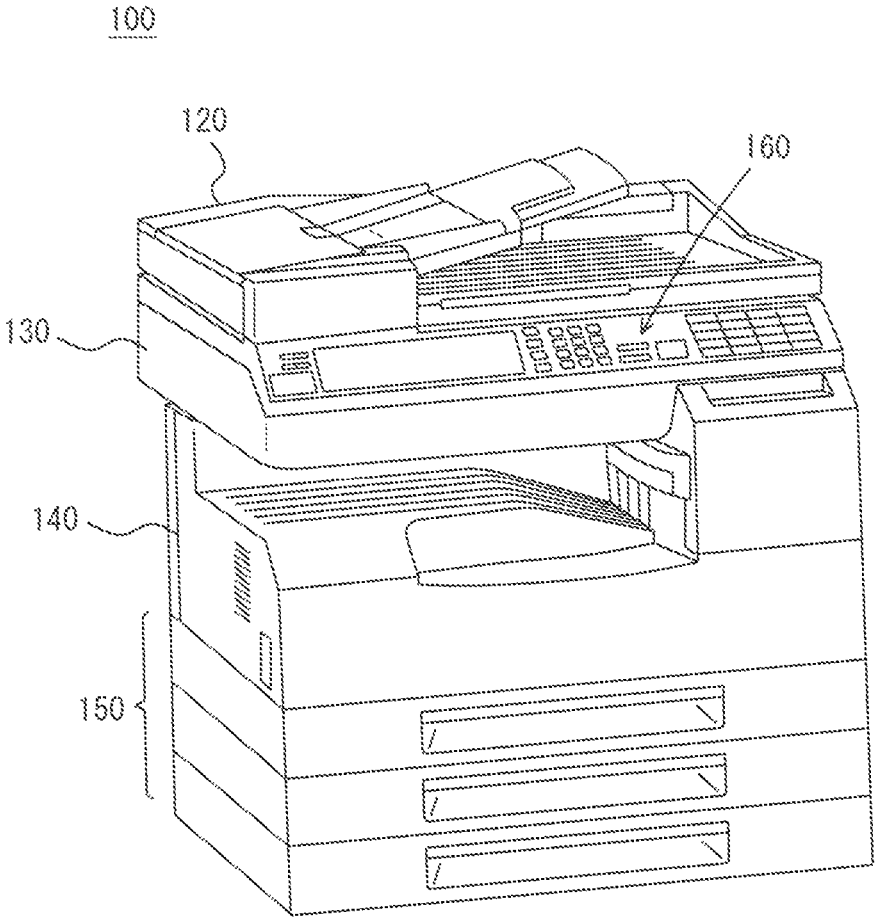
FIG. 1 is a perspective view showing an external appearance of an MFP according to one of the first embodiments of the present invention.

Hereinafter, one or more embodiments of the present invention will be described with reference to the drawings. However, the scope of the invention is not limited to the disclosed embodiments.

Hereinafter, one or more embodiments of the present invention will be described with reference to the drawings. In the following description, the same or corresponding parts are denoted by the same reference characters. Their names and functions are also the same. Thus, a detailed description thereof will not be repeated.

Figure 2:
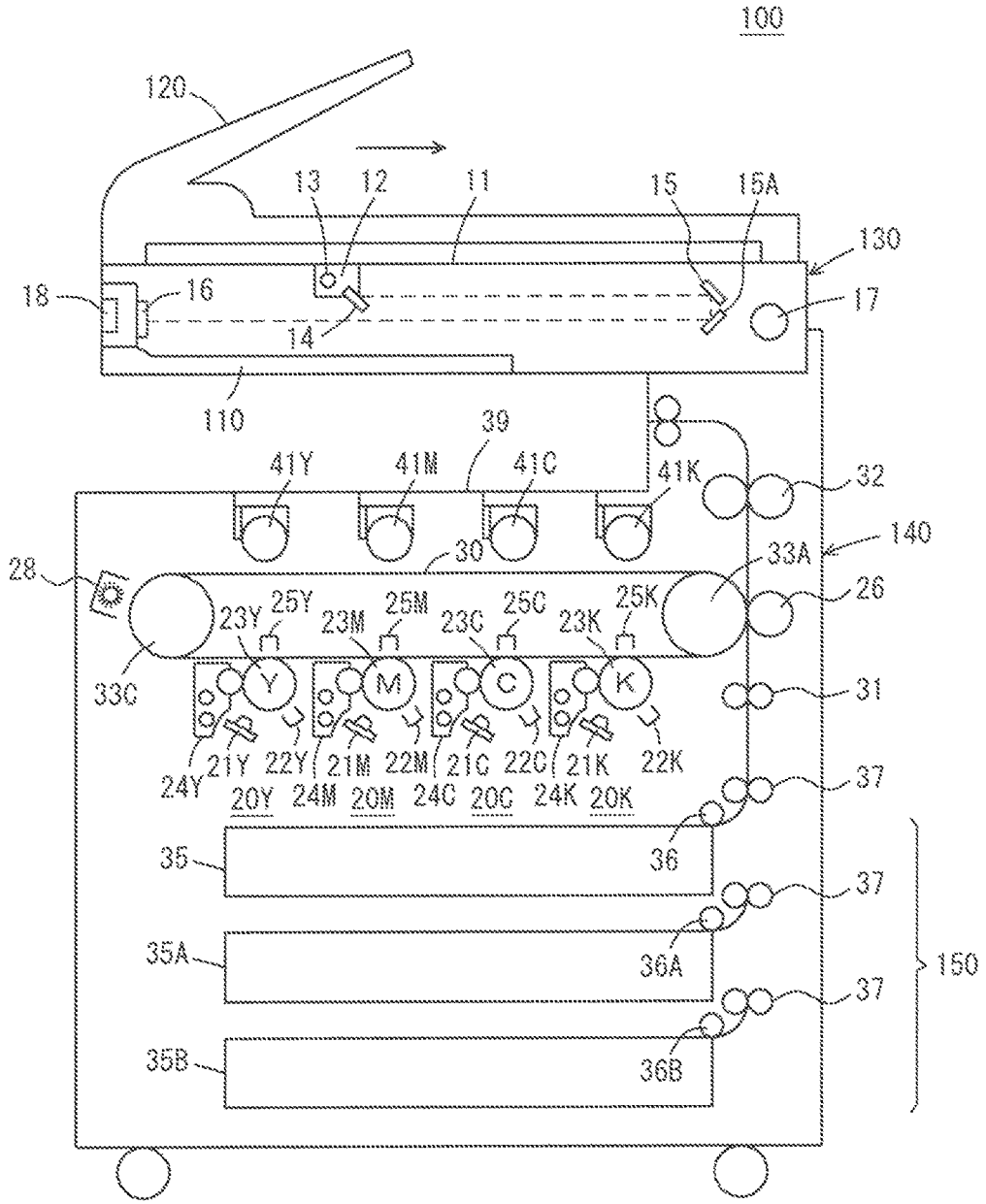
FIG. 2 is a cross-section view schematically showing an internal configuration of the MFP.

FIG. 1 is a perspective view showing an external appearance of a multi-function peripheral (referred to as "MFP") according to one of the first embodiments of the present invention. FIG. 2 is a cross-section view schematically showing an internal configuration of the MFP. Referring to FIGS. 1 and 2, an MFP 100 includes: a document scanning unit 130 for scanning a document; an automatic document feeder 120 for conveying a document to the document scanning unit 130; an image forming unit 140 for forming on a sheet of paper and the like a still image output by the document scanning unit 130 scanning a document; a paper feed unit 150 for supplying sheets of paper to the image forming unit 140; and an operation panel 160 serving as a user interface.

The automatic document feeder 120 separates each of one or more documents placed on a document tray, and conveys one by one to the document scanning unit 130. The document scanning unit 130 exposes an image of a document, which has been conveyed onto a platen glass 11 by the automatic document feeder 120, to an exposure lamp 13 attached to a slider 12 moving beneath the platen glass 11. A reflection light from the document is led by a mirror 14 and two reflection mirrors 15 and 15A to a projection lens 16, and is imaged on a CCD (Charge Coupled Devices) sensor 18. The exposure lamp 13 and the mirror 14 are attached to the slider 12, and the slider 12 is moved by a scanner motor 17 in the direction of arrow as shown in the figure (in a sub scanning direction) at the speed V in accordance with a copy magnification rate. This allows scanning the entire surface of the document placed on the platen glass 11. Further, according to movement of the exposure lamp 13 and the mirror 14, two reflection mirrors 15 and 15A move in the direction of arrow as shown in the figure at the speed V/2. Consequently, an optical path length of the light emitted to the document by the exposure lamp 13 remains constant after reflecting from the document until being imaged on the CCD sensor 18.

The reflection light, which has been imaged on the CCD sensor 18, is converted into image data as an electrical signal within the CCD sensor 18, and is transmitted to a main circuit which is not shown in the figure. The main circuit performs an A/D conversion processing, a digital image processing and the like on the received analog image data, so as to output to the image forming unit 140. The main circuit converts the image data into data for print in cyan (C), magenta (M), yellow (Y) and black (K), so as to output to the image forming unit 140.

The image forming unit 140 includes developing devices 24Y, 24M, 24C and 24K, and their corresponding toner bottles 41Y, 41M, 41C and 41K which are attachable to and detachable from the developing devices 24Y, 24M, 24C and 24K, respectively. Here, "Y", "M", "C" and "K" respectively indicates yellow, magenta, cyan and black. The toner bottles 41Y, 41M, 41C and 41K is an example of a toner storing container. Each of the toner bottles 41Y, 41M, 41C and 41K stores toner of yellow, magenta, cyan and black, respectively. Toners stored in the toner bottles 41Y, 41M, 41C and 41K are respectively supplied to each of the developing devices 24Y, 24M, 24C and 24K via a sub hopper which will be described later.

The image forming unit 140 includes image forming units 20Y, 20M, 20C and 20K, which are for yellow, magenta, cyan and black, respectively. When at least one of the image forming units 20Y, 20M, 20C and 20K is driven, an image is formed. All of the image forming units 20Y, 20M, 20C and 20K are driven, a full color image is formed. The data for print each in yellow, magenta, cyan and black is input to each of the image forming units 20Y, 20M, 20C and 20K. The image forming units 20Y, 20M, 20C and 20K are the same except for color of toner. Therefore, the image forming unit 20Y for forming an image in yellow will be described as an example hereinafter.

The image forming unit 20Y includes: an exposure head 21Y to which the data for print in yellow is input; a photoreceptor drum (an image carrying member) 23Y; an electrostatic charger 22Y; the developing device 24Y; and a transfer charger 25Y. The exposure head 21Y emits a laser light in response to reception of the data for print (electrical signal). The emitted laser light is one-dimensionally scanned by a polygon mirror included in the exposure head 21Y, so as to cause the photoreceptor drum 23Y to be exposed. The direction of one-dimensional scanning of the photoreceptor drum is a main scanning direction.

The photoreceptor drum 23Y, after being charged by the electrostatic charger 22Y, is irradiated with the laser light emitted by the exposure head 21Y. Thus, an electrostatic latent image is formed on the photoreceptor drum 23Y. Next, the developing device 24Y puts toner on the electrostatic latent image so that a toner image is formed. The toner image formed on the photoreceptor drum 23Y is transferred onto an intermediate transfer belt 30 by the transfer charger 25Y.

Meanwhile, the intermediate transfer belt 30 is suspended between a driving roller 33C and a roller 33A so as not to be loosened. When the driving roller 33C rotates counterclockwise as shown in the figure, the intermediate transfer belt 30 rotates counterclockwise as shown in the figure at a predetermined speed. In accordance with rotation of the intermediate transfer belt 30, the roller 33A rotates counterclockwise.

Accordingly, each of the image forming units 20Y, 20M, 20C and 20K consecutively transfers the toner image onto the intermediate transfer belt 30. The timing when each of the image forming units 20Y, 20M, 20C and 20K transfers the toner image onto the intermediate transfer belt 30 is controlled by an event that a reference mark attached to the intermediate transfer belt 30 is detected. Then, toner images each in yellow, magenta, cyan and black respectively are superimposed on the intermediate transfer belt 30.

Sheets of paper in different sizes are set in each of paper feed cassettes 35, 35A and 35B. A sheet of paper in a desired size is carried to a conveyance path by a paper feed rollers 36, 36A and 36B each attached to the paper feed cassettes 35, 35A and 35B respectively. The sheet of paper carried to the conveyance path is carried to a timing roller 31 by a conveyance roller pair 37.

A timing sensor for detecting the reference mark attached to the intermediate transfer belt 30 is provided. When the timing sensor detects the reference mark attached to the intermediate transfer belt 30, the timing roller 31 supplies a sheet of paper to the intermediate transfer belt 30 in synchronization with the detection. The sheet of paper is pressed on the intermediate transfer belt 30 by a transfer roller 26, and then the toner images each in yellow, magenta, cyan and black respectively, which have been formed in a superimposed manner on the intermediate transfer belt 30, are transferred onto the sheet of paper. A cleaner 28 is arranged on an outer circumferential side of the driving roller 33C. The cleaner 28 removes toner remaining on the intermediate transfer belt 30.

The sheet of paper on which the toner images have been transferred is carried to a fixing roller pair 32, and is heated by the fixing roller pair 32. This allows toner to be melted so as to be fixed to the sheet of paper. After that, the sheet of paper is ejected to a sheet ejection tray 39. Here, it will be described about the MFP 100 in tandem system which includes the image forming units 20Y, 20M, 20C and 20K each forming a toner image in different four colors on a sheet of paper, however, there may be used an MFP in 4 cycle system which includes one photoreceptor drum to consecutively transfer each of toner images in different four colors onto a sheet of paper.

In the case of forming an image in full color, the MFP 100 drives all of the image forming units 20Y, 20M, 20C and 20K; whereas in the case of forming an image in monochrome, the MFP 100 drives any one of the image forming units 20Y, 20M, 20C and 20K. Further, the MFP 100 can form an image by combining two or more of the image forming units 20Y, 20M, 20C and 20K.

Figure 3:
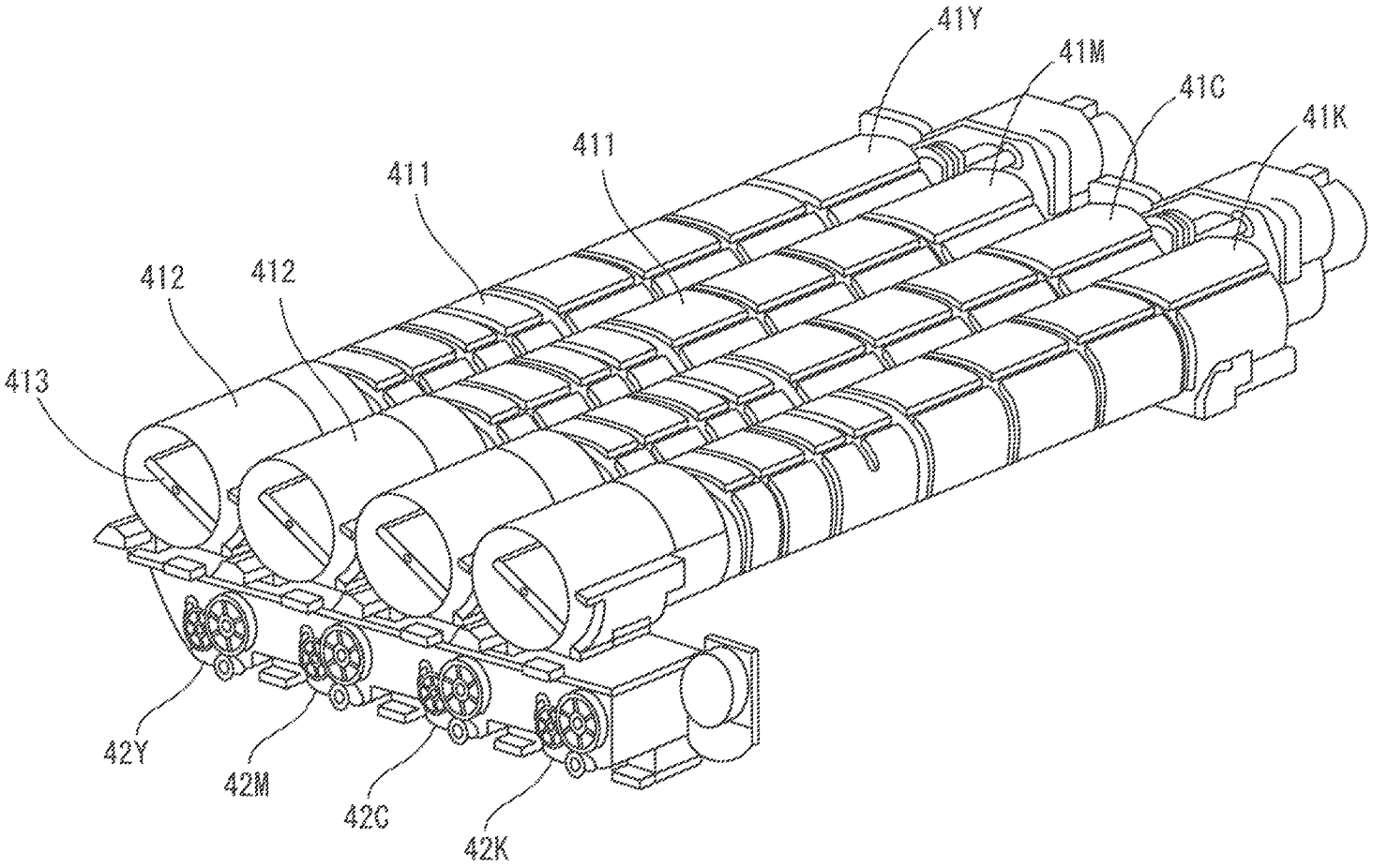
FIG. 3 is a perspective view showing external appearances of a toner bottle and a sub hopper.
Figure 4:
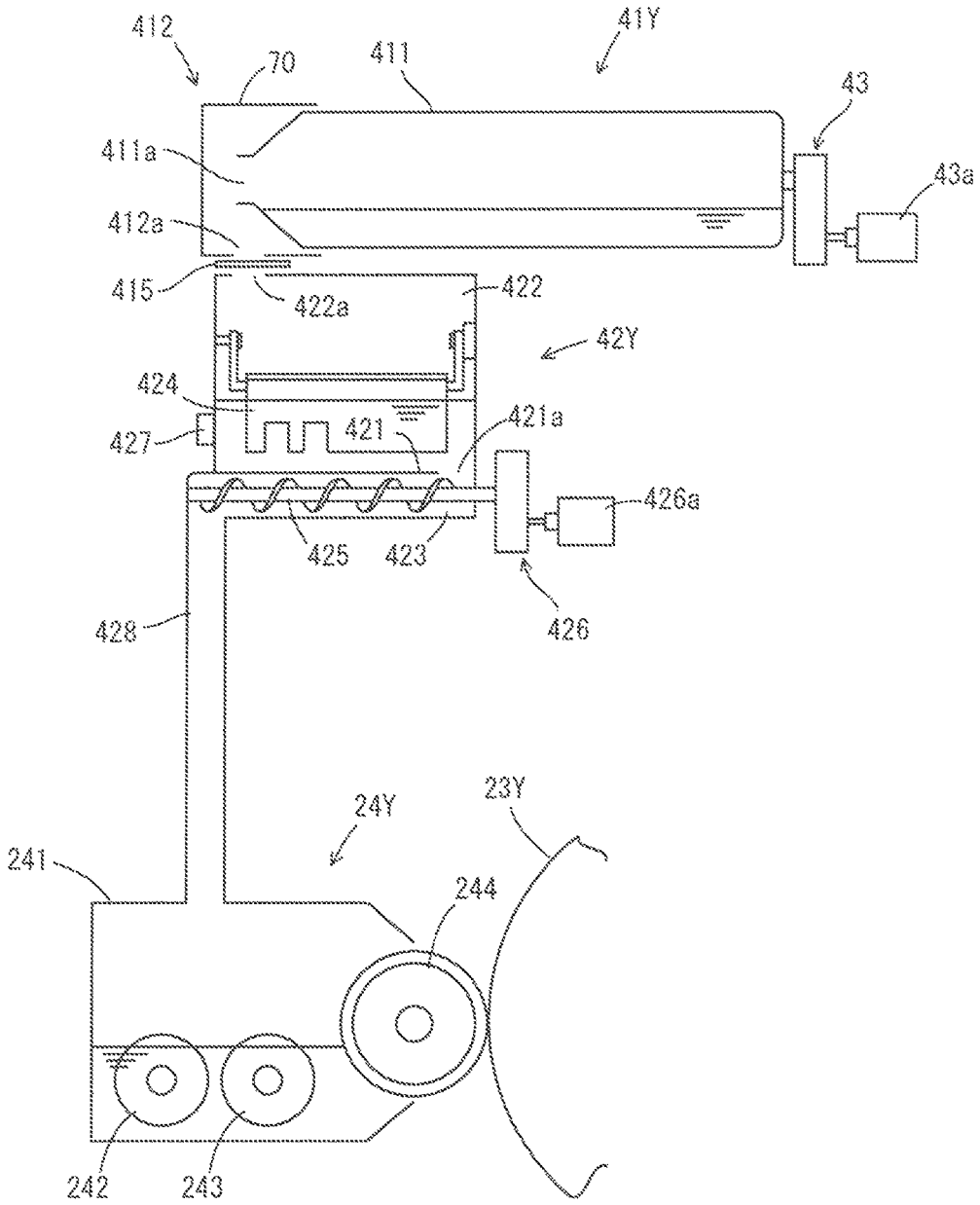
FIG. 4 is a diagram showing internal configurations of the toner bottle, the sub hopper and a developing device.

FIG. 3 is a perspective view showing external appearances of a toner bottle and a sub hopper. FIG. 4 is a diagram showing internal configurations of the toner bottle 41Y, the sub hopper and a developing device. Referring to FIG. 3, each of the toner bottles 41Y, 41M, 41C and 41K includes a bottle portion 411 for storing toner, and a cap portion 412 attached to one end of the bottle portion 411. The cap portion 412 is provided with a knob 413. In a state where the toner bottles 41Y, 41M, 41C and 41K are inserted into the MFP 100, the knob 413 is rotated by a predetermined angle, so that the cap portion 412 is fixed to the MFP 100. Sub hoppers 42Y, 42M, 42C and 42K are integrally provided, each of which corresponds to each of the toner bottles 41Y, 41M, 41C and 41K. In a state where the toner bottles 41Y, 41M, 41C and 41K are inserted into the MFP 100, the cap portion 412 of each of the toner bottles 41Y, 41M, 41C and 41K is arranged above each of the sub hoppers 42Y, 42M, 42C and 42K.

Configurations of the sub hoppers 42Y, 42M, 42C and 42K are almost the same, and configurations of the developing devices 24Y, 24M, 24C and 24K are almost the same. Therefore, internal configurations of the toner bottle 41Y, the sub hopper 42Y and the developing device 24Y will be described here as an example. Referring to FIG. 4, an opening 411*a* is provided at one end of the bottle portion 411, and a cap portion 412 is attached to the bottle portion 411 so as to cover a surrounding surface of the opening 411*a*. The cap portion 412 includes a cap body portion 70 and a shutter portion 415. A supply port 412*a*, which is opened downward, is provided to the cap body portion 70, and a shutter portion 415 is provided to make the supply port 412*a* openable/closable. In a state where the toner bottle 41Y is inserted into the MFP 100, the shutter portion 415 is opened in response to an event that the knob 413 is rotated by a predetermined angle. A bottle rotating member 43 is connected to a bottom part of the bottle portion 411. The bottle rotating member 43 includes a stepping motor 43*a*, and rotating force of the stepping motor 43*a* is transmitted to the bottle portion 411, so that the bottle portion 411Y is rotated.

A supply port 422*a* is provided on an upper part of the sub hopper 42Y so as to overlap the supply port 412*a* of the cap body portion 70. The inside of the sub hopper 42Y is divided into a housing portion 422 and a conveyance portion 423 by a partition 421. A gap 421*a* is formed between one end of the partition 421 and an inner wall surface of the sub hopper 42Y. The gap 421*a* is positioned above one end of the conveyance portion 423, so that the housing portion 422 communicates with the conveyance portion 423 through the gap 421*a*.

When the bottle portion 411 is rotated by the bottle rotating member 43 toner in the bottle portion 411 moves toward the opening 411*a*, and flows out through the opening 411*a*. Then, the toner flowing out through the opening 411*a* moves through the supply port 412*a* of the cap portion 412 as well as through the supply port 422*a* of the sub hopper 42Y, and falls down into the housing portion 422 of the sub hopper 42Y.

The housing portion 422 is provided with a floating member 424 which swings around a horizontal axis. Inclination of the floating member 424 changes in accordance with an amount of toner inside the housing portion 422. An empty sensor 427 is provided on an outer surface of the housing portion 422. When the inclination of the floating member 424 becomes large due to a shortage of the amount of toner in the housing portion 422, the empty sensor 427 detects a detected object (a magnet, for example) attached to the floating member 424.

The conveyance portion 423 is provided with a supply roller 425 having a helical screw around a shaft. The supply roller 425 is connected to a sub hopper driving member 426. The sub hopper driving member 426 includes a stepping motor 426*a*, and rotating force of the stepping motor 426*a* is transmitted to the supply roller 425, so that the supply roller 425 is rotated. The other end which is opposite to the end of the conveyance portion 423 (the end on the side of the gap 421*a*) is connected to the developing device 24Y via a conveyance portion 428. When the supply roller 425 is rotated by the sub hopper driving member 426, toner is conveyed from the end to the other end of the conveyance portion 423, so as to be supplied to the developing device 24Y through the conveyance portion 428.

The developing device 24Y includes a housing portion 241, a conveyance rollers 242 and 243, and a developing roller 244. Toner supplied from the sub hopper 42Y is stored in the housing portion 241. The conveyance rollers 242 and 243 are arranged inside the housing portion 241, and the developing roller 244 is arranged in a manner as to be partially exposed from the housing portion 241. The conveyance rollers 242 and 243 are rotated by a motor which is not shown in the figure, so as to convey toner in the housing portion 241 to the developing roller 244. An outer circumferential surface of the developing roller 244 is arranged to face an outer circumferential surface of the photoreceptor drum 23Y. When being rotated by a motor which is not shown in the figure, the developing roller 244 conveys toner in the housing portion 241 while holding it thereon, and transfer the toner onto the electrostatic latent image formed on the photoreceptor drum 23Y.

Figure 5:
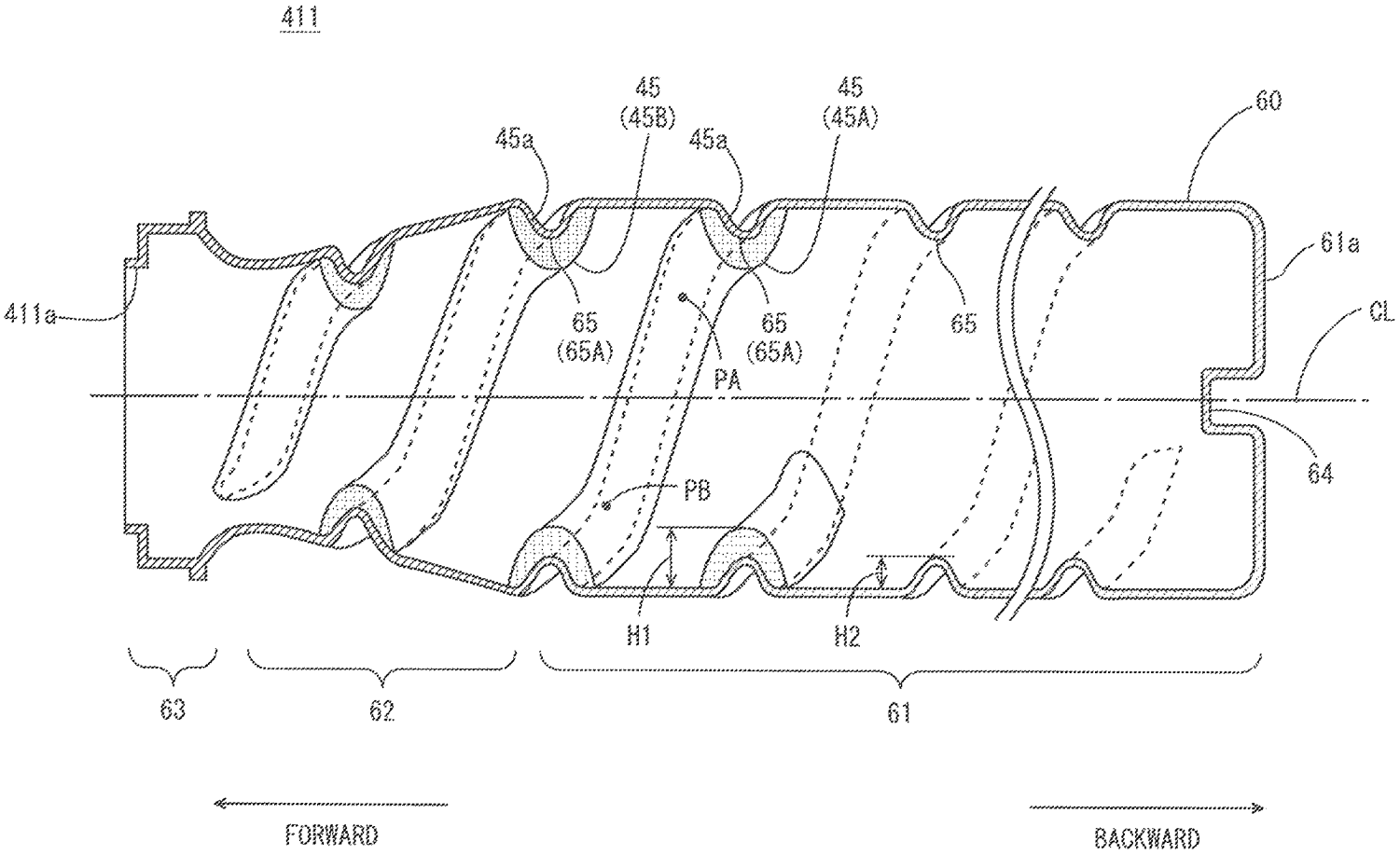
FIG. 5 is a cross-section view of a bottle portion.

FIG. 5 is a cross-section view of the bottle portion 411. Referring to FIG. 5, the bottle portion 411 includes a container body 60 and a toner conveyer 45. The container body 60 is integrally formed, for example, by blow molding, and has a uniform thickness. The container body 60 includes a body portion 61, a taper 62 and a cap attaching portion 63. The body portion 61 extends in a substantially cylindrical shape, and includes a bottom portion 61*a* at one end. A fitting groove 64 is formed to the bottom portion 61*a*, and a part of the bottle rotating member 43 in FIG. 4 is fitted into the fitting groove 64. This allows transmission of rotating force from the bottle rotating member 43 to the bottle portion 411. The taper 62 extends from another end of the body portion 61 toward the opening 411*a* so as to gradually become small in diameter. The cap attaching portion 63 including the opening 411*a* is provided at a tip of the taper 62.

As described below, it is assumed that a direction from the bottom portion 61*a* of the container body 60 toward the opening 411*a* indicates a forward direction, and a direction from the opening 411*a* toward the bottom portion 61*a* indicates a backward direction. Further, the axis of the container body 60 is named a center line CL, and a direction orthogonal to the center line CL is named a diameter direction. In the present embodiment, the center line CL is horizontal.

The container body 60 includes an inner circumferential surface extending toward the opening 411*a* around the center line CL. The container body 60 includes a projection 65 which projects inward from the inner circumferential surface as well as spirally extends around the center line CL from a rear end of the body portion 61 to a front end of the taper 62. The toner conveyer 45 is attached onto the inner circumferential surface of the container body 60 so as to be arranged along the projection 65 in, at least, the taper 62. In the present embodiment, a pair of the projection 65 is arranged in parallel at regular intervals so as to form a double spiral. Further, a pair of the toner conveyer 45 is attached so as to be arranged along each of the pair of the projection 65. In FIG. 5 and other figures described below, in order to distinguish one from the other of the pair of the projection 65, one of the pair of the projection 65 is denoted by "65A" and another is denoted by "65B". Further, in order to distinguish one from the other of the pair of the toner conveyer 45, one of the pair of the toner conveyer 45 is denoted by "45A" and another is denoted by "45B". Part of the projection 65A and part of the projection 65B are alternately arranged in the forward and backward directions. The toner conveyer 45A is attached to be arranged along the projection 65A, while the toner conveyer 45B is attached to be arranged along the projection 65B. Here, it should be noted that only one of the pair of the projection 65 may be formed in the container body 60, and only one of the pair of the toner conveyer 45 may be attached to the container body 60. Further, the one projection 65A may be formed from a rear end of the body portion 61 to a front end of the taper 62 in the container body 60, and only in a partial area thereof (an area close to the opening 411*a*, for example), the other projection 65B may be formed so as to form a double spiral.

Figure 6:
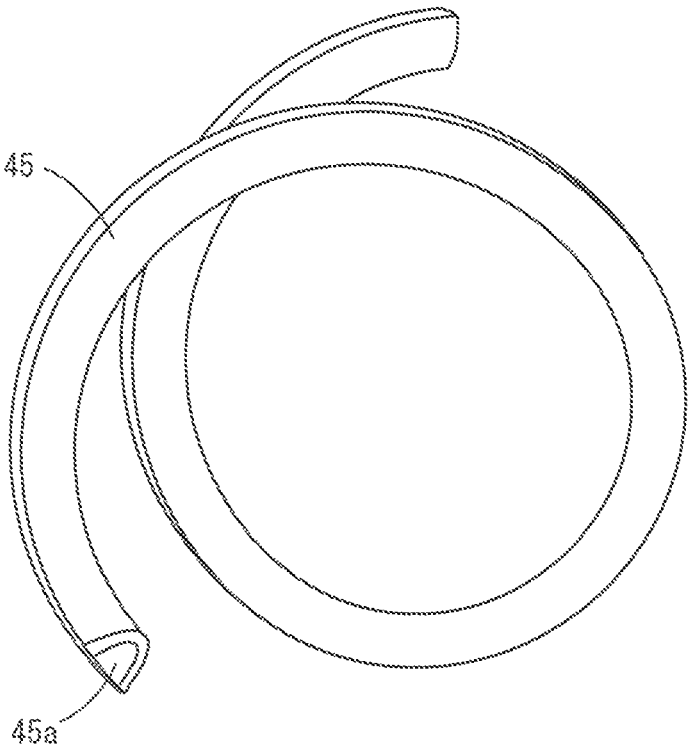
FIG. 6 is a perspective view showing an external appearance of a toner conveyer.

FIG. 6 is a perspective view showing an external appearance of the toner conveyer 45. Referring to FIG. 6, the toner conveyer 45 has a spiral shape in which an inner circumference draws a spiral. The toner conveyer 45 has a shape in which an inner diameter of the part corresponding to the body portion 61 is constant, and an inner diameter of the part corresponding to the taper 62 gradually becomes small toward an end point (in a forward direction in a state where the toner conveyer 45 is attached to the container body 60). Referring to FIGS. 5 and 6, the toner conveyer 45 is attached to the container body 60 so as to cover at least a part of the projection 65. The toner conveyer 45 spirally extends around the center line CL in a state of being attached to the container body 60. The direction in which the toner conveyer 45 extends includes an element of a circumferential direction around the center line CL and an element of the forward and backward directions parallel with the center line CL.

The toner conveyer 45, in a state of being attached to the container body 60, extends in a circumferential direction around the center line CL along the inner circumferential surface of the container body 60, while maintaining a constant angle with a surface perpendicular to the center line CL. In FIG. 5, a position in a first length from a rear end of the toner conveyer 45 is denoted by a position PA, while a position in a second length from a rear end of the toner conveyer 45, which is longer than the first length, is denoted by a position PB. In a state where the toner conveyer 45 is attached to the container body 60, the position PB is closer to the opening 411*a* than the position PA is. It is preferable that the toner conveyer 45, in a state of being attached to the container body 60, has a length longer than one circumference (360 degrees) in a circumferential direction around the center line CL.

In the present embodiment, the toner conveyer 45, in a state of being attached to the container body 60, extends from a vicinity of a front end of the taper 62 to a predetermined position of the body portion 61. The toner conveyer 45 is formed separately from the container body 60, and attached within the container body 60. The toner conveyer 45 may be attachable to and detachable from the container body 60, may be bonded to the container body 60 with an adhesive and the like, and may be fixed to the container body 60 by welding and the like.

A recessed portion 45*a* is formed on an outer circumferential part from a front end to a rear end of the toner conveyer 45. The projection 65 of the container body 60 is fitted into the recessed portion 45*a* of the toner conveyer 45. An inward projection height H1 of the toner conveyer 45 is larger than an inward projection height H2 of the projection 65. The toner conveyer 45 has a shape which corresponds to an inner surface shape of the bottle portion 411, and the part of the toner conveyer 45 which is arranged within the taper 62, gradually approaches the center line CL as it approaches a front end of the taper 62.

At the time of attaching the toner conveyer 45, in a state where a front end of the projection 65 is fitted into the recessed portion 45*a* of a rear end of the toner conveyer 45, the toner conveyer 45 is rotated around the center line CL, facing toward the container body 60. This allows the toner conveyer 45 to be gradually inserted along the projection 65 into the container body 60 and to be arranged in a predetermined position. In order that an inserting direction of the toner conveyer 45 to the container body 60 can be readily recognized upon attachment, a mark indicating the forward and backward directions or a mark indicating a rotating direction may be attached to the toner conveyer 45.

Here, it should be noted that a size of a diameter direction of a rear end of the toner conveyer 45 is larger than a size of a diameter direction of a front end of the taper 62. Therefore, in order to readily attach the toner conveyer 45 within the bottle portion 411, it is preferable that the toner conveyer 45 includes flexibility so as to be reversibly deformed.

FIG. 7 is a diagram showing an example of materials for the toner conveyer 45 and characteristics thereof. Referring to FIG. 7, as materials for the toner conveyer 45, there may be used a polyethylene terephthalate (PET), a high density polyethylene (HDPE), a low density polyethylene (LDPE), a polystyrene (PS), a polyvinyl chloride (PVC), a polypropylene (PP), a silicon (SI), and a polyurethane resin (PUR). Especially, the polyvinyl chloride has a low price and high moldability. Further, flexibility of the polyvinyl chloride can be readily increased by adding plasticizer. Therefore, the polyvinyl chloride is suitable for mass production. Meanwhile, the silicon and the polyurethane include high flexibility and high adhesion. Therefore, in the case where the silicon or the polyurethane is used, it is possible to prevent a positional displacement of the toner conveyer 45 in the bottle portion 411.

Figure 8:
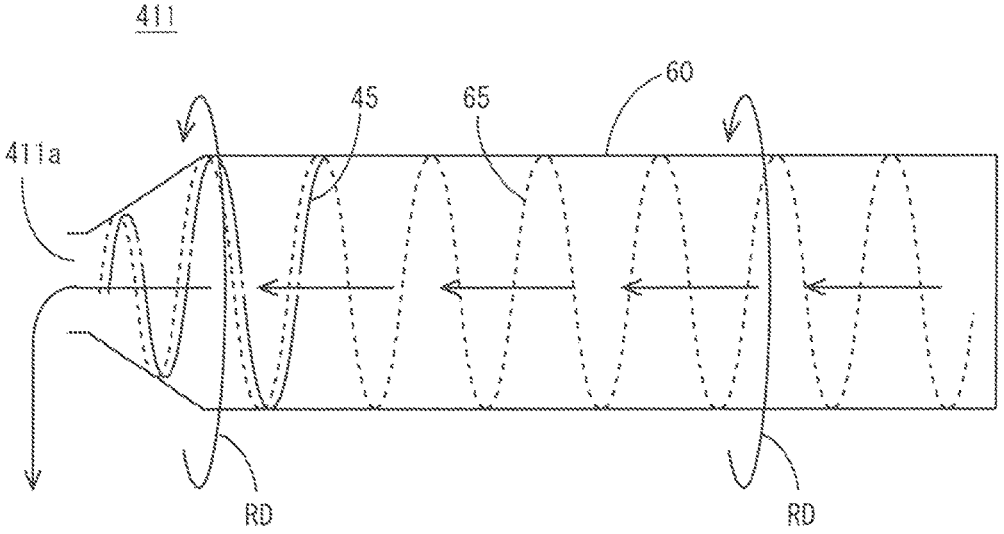
FIG. 8 is a schematic view for explaining movement of toner inside the toner bottle.

FIG. 8 is a schematic view for explaining movement of toner inside the bottle portion 411. In FIG. 8, the projection 65 is shown by a dotted line, and the toner conveyer 45 is shown by a one-dot dash line. Further, in FIG. 8 and FIGS. 12 and 13 described later, only one of the pair of the projection 65 and one of the pair of the toner conveyer 45 are schematically shown. Referring to FIG. 8, a direction of spirals of the projection 65 and the toner conveyer 45 corresponds to a rotating direction RD of the bottle portion 411 by the bottle rotating member 43 (in FIG. 3). Specifically, the projection 65 and the toner conveyer 45 extend forward along the same direction as the rotating direction RD of the bottle portion 411. Accordingly, when the bottle portion 411 is rotated by the bottle rotating member 43, toner in the bottle portion 411 is conveyed forward by the projection 65 and the toner conveyer 45 so as to be led to the opening 411*a*.

Figure 9:
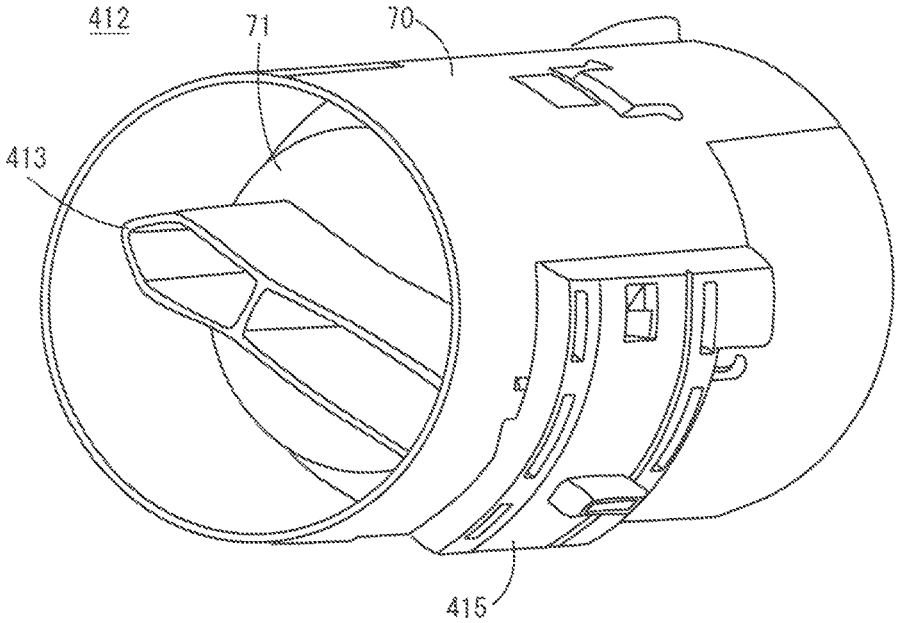
FIG. 9 is a perspective view showing an external appearance of a cap portion.
Figure 10:
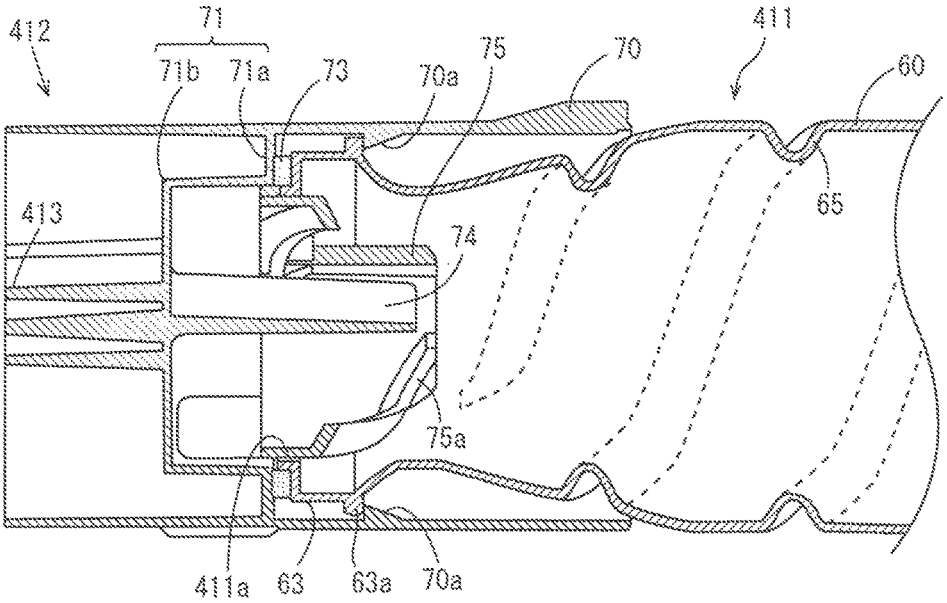
FIG. 10 is a cross-section view showing a state where the cap portion is attached to the bottle portion.

FIG. 9 is a perspective view showing an external appearance of the cap portion 412. FIG. 10 is a cross-section view showing a state where the cap portion 412 is attached to the bottle portion 411. In FIG. 10, an illustration of the toner conveyer 45 is omitted. Referring to FIG. 9, the cap body portion 70 of the cap portion 412 has a substantially cylindrical shape, and the shutter portion 415 is attached onto an outer circumferential surface of the cap body portion 70. The shutter portion 415 is opened in response to an event of being moved by a predetermined angle in a circumferential direction with respect to the cap body portion 70. This allows the supply port 412*a* provided to the cap body portion 70 to be exposed (in FIG. 4). A sealing wall 71 is provided inside the cap body portion 70. The knob 413 is provided so as to project forward from the sealing wall 71.

Referring to FIG. 10, a projection 63*a* is provided to the cap attaching portion 63 of the bottle portion 411 so as to project outward. Meanwhile. a pawl portion 70*a* is provided on an inner circumferential surface of the cap body portion 70. When the cap attaching portion 63 of the container body 60 is inserted into the cap body portion 70, the projection 63*a* of the container body 60 is locked by the pawl portion 70*a* of the cap body portion 70. This allows the cap portion 412 to be attached to the bottle portion 411.

The sealing wall 71 includes a circumferential edge sealing portion 71*a* which has an annular shape and extends with a constant width along an inner circumferential surface of the cap body portion 70, and a projecting portion 71*b* which projects forward in a convex way from an inner end of the circumferential edge sealing portion 71*a*. A sealing member 73 having an annular shape is attached onto a rear surface of the circumferential edge sealing portion 71*a*. When the cap portion 412 is attached to the bottle portion 411, a front end of the cap attaching portion 63 closely adheres to the sealing member 73. This allows the opening 411*a* of the bottle portion 411 is sealed by the sealing wall 71. The projecting portion 71*b* is positioned in a forward direction of the opening 411*a* of the bottle portion 411, and a space inside the projecting portion 71*b* communicates with the supply port 412*a* (in FIG. 4). Therefore, the toner flowing out through the opening 411*a* of the bottle portion 411 is led through the space inside the projecting portion 71*b* to the supply port 412*a* (in FIG. 4).

A stirring piece 74 is formed in a plate shape so as to extend backward from the projecting portion 71*b*. The stirring piece 74 is inserted into the bottle portion 411 through the opening 411*a*. When the bottle portion 411 is rotated facing the cap portion 412, toner collected in a vicinity of the opening 411*a* of the bottle portion 411 is stirred by the stirring piece 74. This prevents aggregation of the toner in a vicinity of the opening 411*a*.

The cap portion 412 further includes a rotating member 75 having a substantially cylindrical shape. The rotating member 75 is provided separately from the cap body portion 70, and is fitted into the opening 411*a* of the bottle portion 411 when the cap portion 412 is attached to the bottle portion 411. This allows the rotating member 75 to rotate facing the cap body portion 70 along with the bottle portion 411. A projection 75*a*, which extends spirally, is formed on an inner circumferential surface of the rotating member 75. The rotating member 75 supports conveyance of toner inside the cap attaching portion 63 of the bottle portion 411.

In the case where an amount of toner inside the bottle portion 411 decreases, an amount of toner which is supplied from the bottle portion 411 to the sub hopper may become unstable. Especially, in the present embodiment, since the center line CL of the bottle portion 411 is horizontal and the bottle portion 411 includes the taper 62, movement of toner inside the bottle portion 411 is prevented by inclination of the taper 62.

In order to prevent inclination from occurring in the bottle portion 411, it may be considered to mold the container body 60 without providing the taper 62 so as to have approximately uniform diameter from the bottom portion 61*a* to the opening 411*a*. However, in that case, when toner is filled into the bottle portion 411, the toner can be readily scattered and contaminants can readily intrude into the bottle portion 411, and thus toner filling efficiency is deteriorated. Further, if the taper 62 is not provided, it is required to increase a size of the cap portion 412, and thus it becomes difficult to secure a space for attaching a toner bottle to the MFP 100. Furthermore, since a sliding area between the bottle portion 411 and the MFP 100 as well as between the bottle portion 411 and the cap portion 412 becomes larger, a driving load to the bottle portion 411 is increased. Taking into consideration these cases mentioned above, it is preferable to provide the taper 62 to the bottle portion 411.

Meanwhile, in order to enhance a conveying efficiency of toner conveyed by the projection 65 of the container body 60, it may be considered to enlarge the projection height of the projection 65, but it is not easy to perform. It is generally common for the container body 60 to be manufactured by blow molding in view of superiority in cost. Specifically, the container body 60 is formed by injecting air into a resin in a metal mold to inflate the resin. In this case, the opening 411*a* is an air injection port. The metal mold is provided with a projection corresponding to the projection 65. It is possible to enlarge the projection height of the projection 65 by enlarging the height of the projection of the metal mold, however, a contact area between the metal mold and the container body 60 becomes large, as well as an uneven shape of the contact area becomes complex. Therefore, a release failure may readily occur so that mass production can hardly be realized.

In the present embodiment, the toner conveyer 45 is provided to the bottle portion 411, and this makes it possible to increase the conveying efficiency of toner by using the container body 60 which includes the taper 62 and maintains the projection height of the projection 65.

Figure 11:
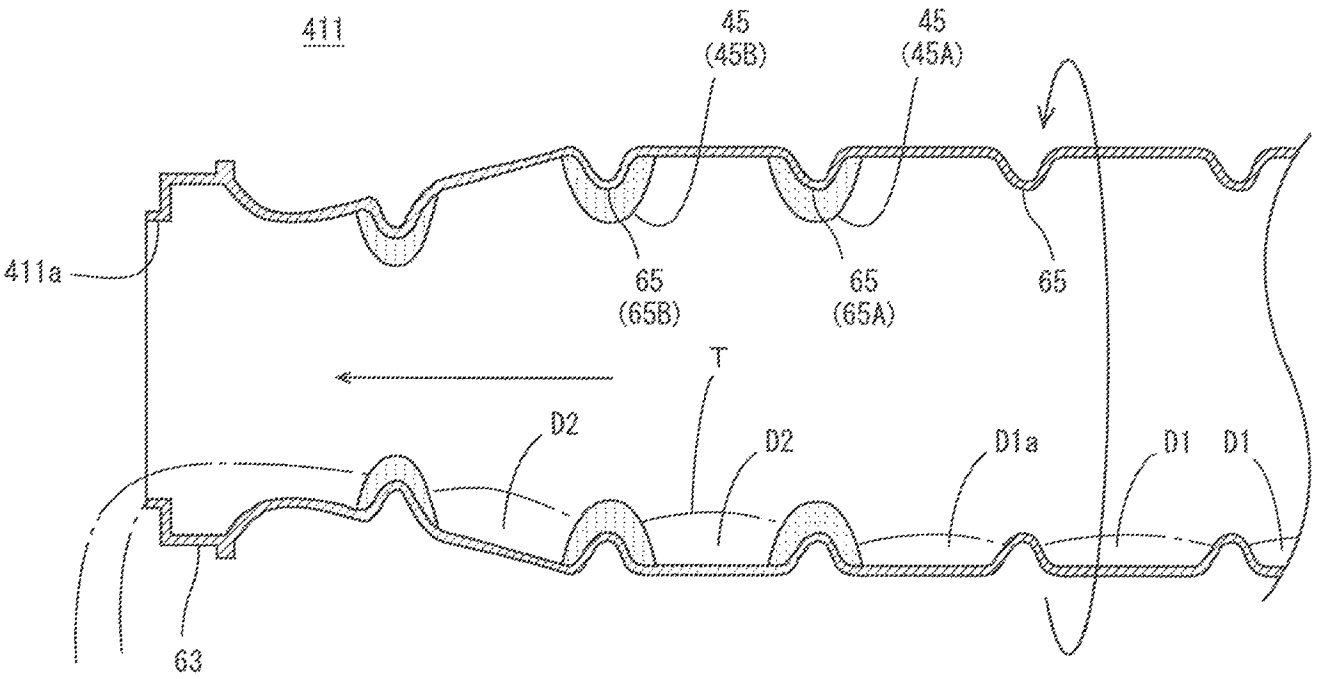
FIG. 11 is a diagram for explaining conveyance of toner in a state where an amount of toner is decreased.

FIG. 11 is a diagram for explaining conveyance of toner in a state where an amount of toner is decreased. Cut surfaces of the container body 60 and the toner conveyer 45 are shown in FIG. 11. Referring to FIG. 11, when an amount of toner T is decreased in the bottle portion 411, the toner is collected to a lower part of the bottle portion 411 by the force of gravity. In the lower part of the bottle portion 411, a plurality of a groove portion D1 are partitioned by the projection 65, and a plurality of a groove portion D2 are partitioned by the toner conveyer 45. Further, between the groove portion D1 and the groove portion D2, a groove portion D1*a* is partitioned by the projection 65 and the toner conveyer 45. A bottom face of each of the groove portion D1, the groove portion D1*a* and the groove portion D2 is included in an inner circumferential surface of the container body 60. The toner collected in the lower part of the bottle portion 411 is stored in each of the groove portion D1, the groove portion D1*a* and the groove portion D2.

When the bottle portion 411 is rotated, a position of each of the groove portion D1, the groove portion D1*a* and the groove portion D2 is shifted forward within a predetermined range, and this allows the toner in each of the groove portion D1, the groove portion D1*a* and the groove portion D2 to be conveyed forward. Since the depth of the groove portion D1 corresponds to the projection height H2 of the projection 65 (in FIG. 5), and the depth of the groove portion D2 corresponds to the projection height H1 of the toner conveyer 45 (in FIG. 5), the groove portion D2 is deeper than the groove portion D1. Therefore, a relatively large amount of toner is stored in the groove portion D2. This allows, in an area where the toner conveyer 45 is attached, sufficiently securing an amount of conveyed toner and enhancing the conveying efficiency of toner. Especially, also in the taper 62, it is possible to sufficiently secure the amount of toner in the groove portion D2. This makes it possible to stably lead toner to the opening 411*a* even if inclination of the taper 62 is obstructive to movement of toner. Accordingly, this allows toner to stably flow from the opening 411*a*. As a result, it is possible to stably supply toner to the sub hopper and the developing device.

<Method for Manufacturing>

Figure 12:
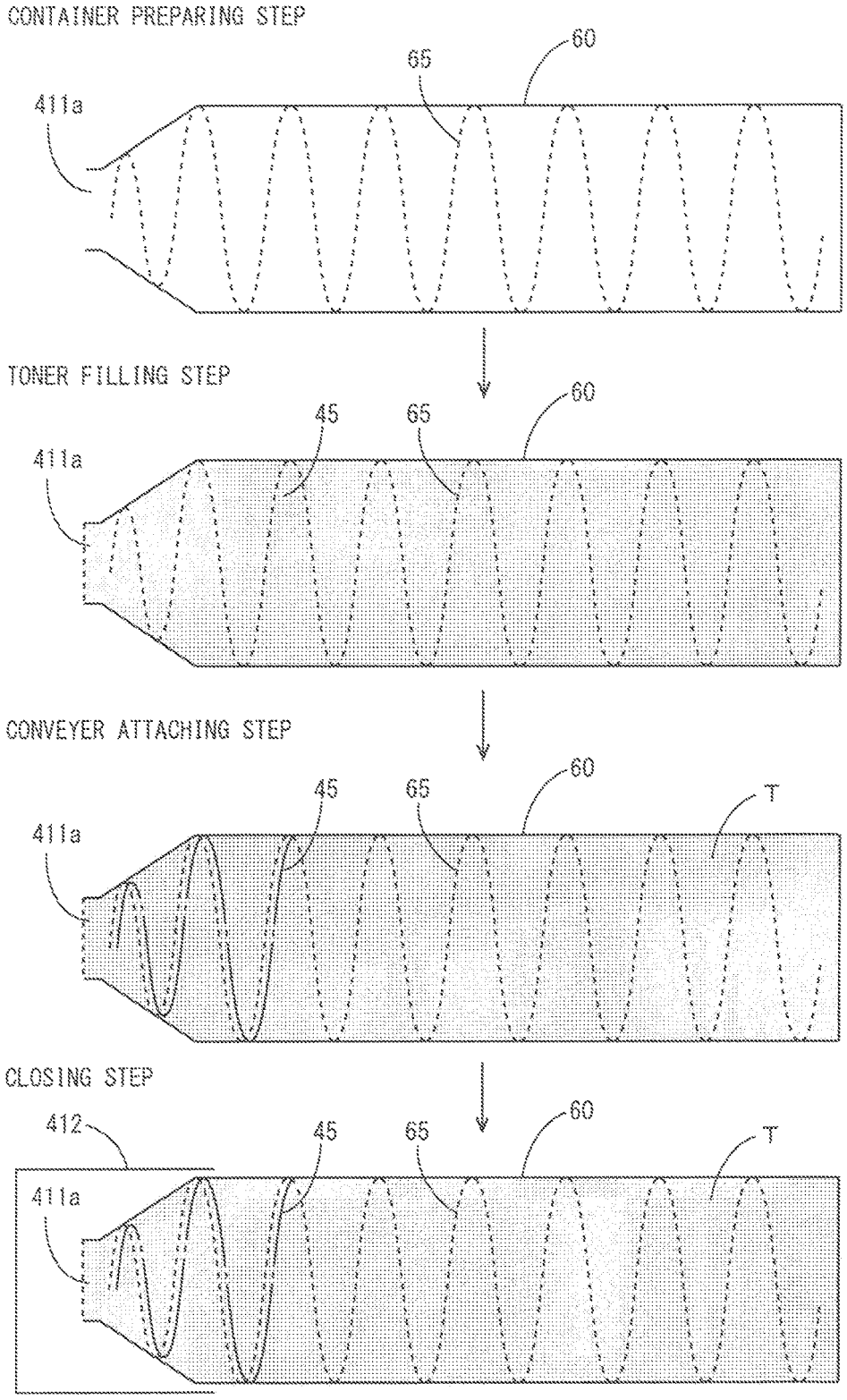
FIG. 12 is a schematic view for explaining a first example of a method for manufacturing the toner bottle.

FIG. 12 is a schematic view for explaining the first example of a method for manufacturing a toner bottle. Referring to FIG. 12, at first, the container body 60 including the opening 411*a* is prepared (container preparing step). For example, the container body 60 is integrally manufactured by blow molding. Next, the toner T is filled into the container body 60 (toner filling step). Next, the toner conveyer 45 is attached onto the inner circumferential surface of the container body 60 (conveyer attaching step). Specifically, the toner conveyer 45 is inserted from the opening 411*a* into the container body 60, and the projection 65 of the container body 60 is fitted into the recessed portion 45*a* of the toner conveyer 45 by rotating the toner conveyer 45. After that, the cap portion 412 is attached so as to close the opening 411*a* of the container body 60 (closing step). Accordingly, a toner bottle is completed. In the present embodiment, the toner conveyer 45 is attached after the toner T is filled into the container body 60, and this prevents the toner conveyer 45 from being obstructive to filling of the toner T, and thus it is possible to fill a sufficient amount of toner into the container body 60.

Figure 13:
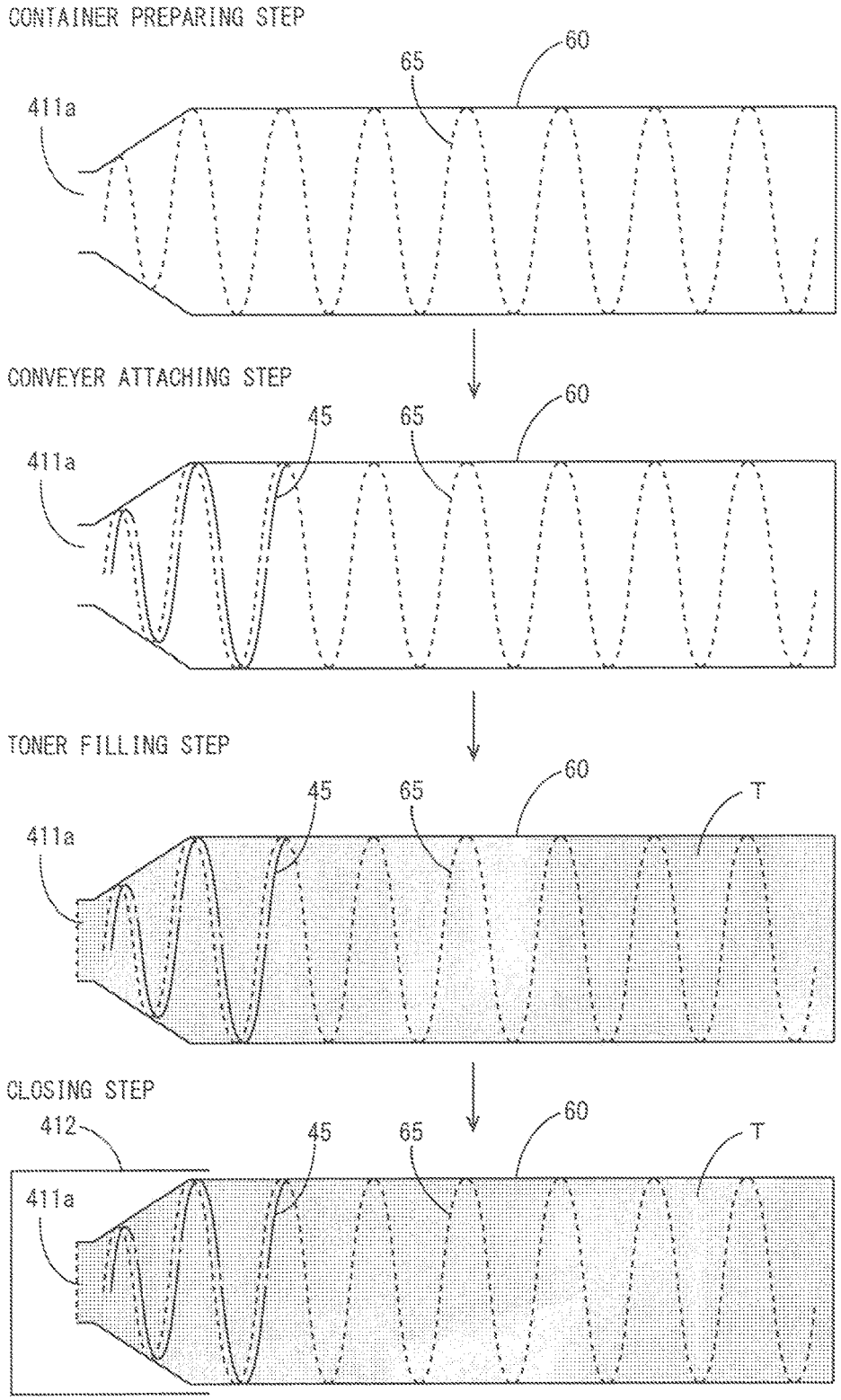
FIG. 13 is a schematic view for explaining a second example of a method for manufacturing the toner bottle.

FIG. 13 is a schematic view for explaining the second example of a method for manufacturing a toner bottle. Referring to FIG. 13, the second example of a method for manufacturing a toner bottle is different from the first example shown in FIG. 12 in the point where the order of the conveyer attaching step and the toner filling step is reversed. In this case, since toner is filled after the toner conveyer 45 is attached to the container body 60, the toner T is not obstructive to the attachment of the toner conveyer 45 and it is possible to readily attach the toner conveyer 45 to the container body 60.

As explained above, in the toner bottle according to the present embodiment, the toner conveyer 45, which projects inward from the inner circumferential surface of the container body 60 as well as spirally extends in the one direction around the center line CL of the container body 60, is attached onto the inner circumferential surface of the container body 60. When the container body 60 is rotated facing the MFP 100, toner in the container body 60 is conveyed toward the opening 411*a* by the toner conveyer 45. Since the toner conveyer 45 is provided separately from the container body 60, a size of the toner conveyer 45 can be adjusted at a high degree of freedom. Therefore, it is possible to readily enlarge an inward projection height of the toner conveyer 45, and thus enhance the conveying efficiency of toner in the container body 60. As a result, it is possible to stably supply toner to the MFP 100.

Further, the container body 60 includes the projection 65 which projects inward from the inner circumferential surface as well as spirally extends in the one direction around the center line CL, and the toner conveyer 45 is attached to the container body 60 so as to cover at least a part of the projection 65. This facilitates attachment of the toner conveyer 45 to the container body 60.

Further, the container body 60 includes the taper 62 which extends in the one direction toward the opening 411*a* so as to gradually become small in diameter. This facilitates arrangement of another materials at the surrounding of the opening 411*a*. Further, since an amount of toner conveyed is sufficiently secured by the toner conveyer 45, it is possible to stably lead toner to the opening 411*a* even if inclination of the taper 62 is obstructive to movement of toner.

Further, since toner is stably supplied from the toner bottle to each of the developing devices 24Y, 24M, 24C and 24K of MFP 100, an amount of toner in each of the developing devices 24Y, 24M, 24C and 24K becomes stable, and thus it is possible to stabilize image quality of the toner image.

<First Modified Example>

Figure 14A:
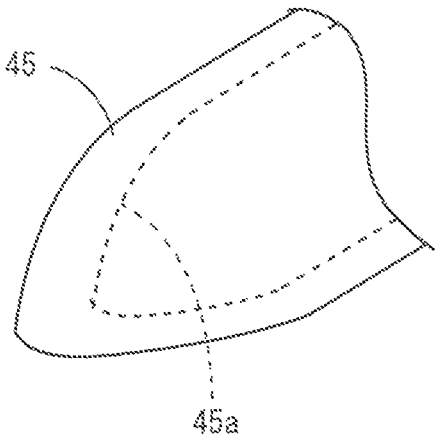
FIGS. 14A and 14B each is a diagram showing the toner conveyer according to a first modified example.
Figure 14B:
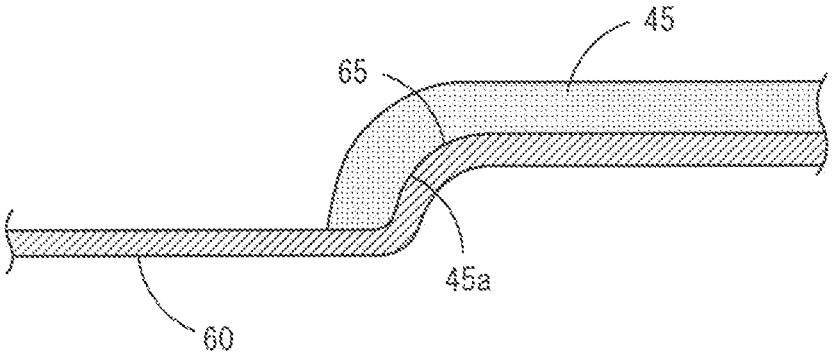

A toner bottle according to the first modified example has a changed shape of a front end of the toner conveyer 45. FIGS. 14A and 14B each is a diagram showing the toner conveyer 45 according to the first modified example. FIG. 14A shows an external appearance of the front end of the toner conveyer 45, while FIG. 14B shows a cross-section view of the front end of the toner conveyer 45. The toner conveyer 45 according to the first modified example is different from examples shown in FIGS. 5 and 6 in the point where the recessed portion 45*a* is not formed from a front end of the toner conveyer 45 but formed from a position separated by a constant distance from the front end. In this case, when the toner conveyer 45 is attached to the container body 60, a front end face of the recessed portion 45*a* is locked by a front end of the projection 65 of the container body 60. This prevents the toner conveyer 45 from being inserted more backward than a predetermined position, and positioning of the toner conveyer 45 is facilitated.

Figure 15A:
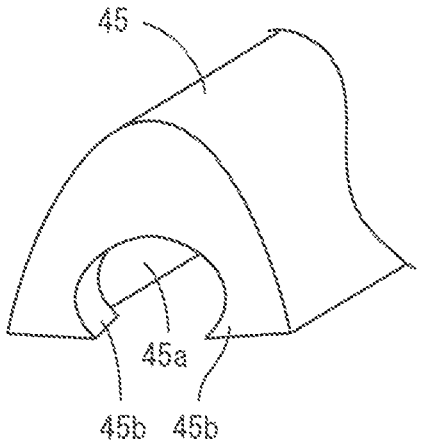
FIGS. 15A and 15B each is a diagram showing the toner conveyer according to a further modified example of the first modified example.
Figure 15B:
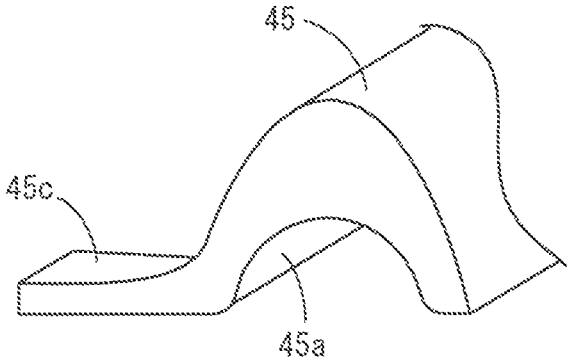

FIGS. 15A and 15B each is a diagram showing the toner conveyer 45 according to a further modified example of the first modified example. FIGS. 15A and 15B each shows an external appearance of a front end of the toner conveyer 45. In the example shown in FIG. 15A, a projecting portion 45*b* which projects toward inside of the recessed portion 45*a* is formed at the front end of the toner conveyer 45. In this case, when the toner conveyer 45 is attached to the container body 60, the projecting portion 45*b* is locked by a front end of the projection 65 of the container body 60. This prevents the toner conveyer 45 from being inserted more backward than a predetermined position, and positioning of the toner conveyer 45 is facilitated. In the example shown in FIG. 15B, a projecting portion 45*c* is formed on a side face of the toner conveyer 45. In this case, a locking portion which locks the projecting portion 45*c* is provided in part of the container body 60 in a vicinity of the front end of the projection 65, and thus positioning of the toner conveyer 45 is facilitated.

A front end surface of the recessed portion 45*a* according to the first modified example, and the projecting portions 45*b* and 45*c* according to the further modified example of the first modified example, show an example of a positioner for positioning the toner conveyer 45 in the container body 60. It should be noted that, the positioner may be provided for positioning the toner conveyer 45 in the projection 65 of the container body 60. For example, on a predetermined position of the projection 65, a projection and the like which lock a rear end of the toner conveyer 45 may be provided as a positioner.

<Second Modified Example>

Figure 16:
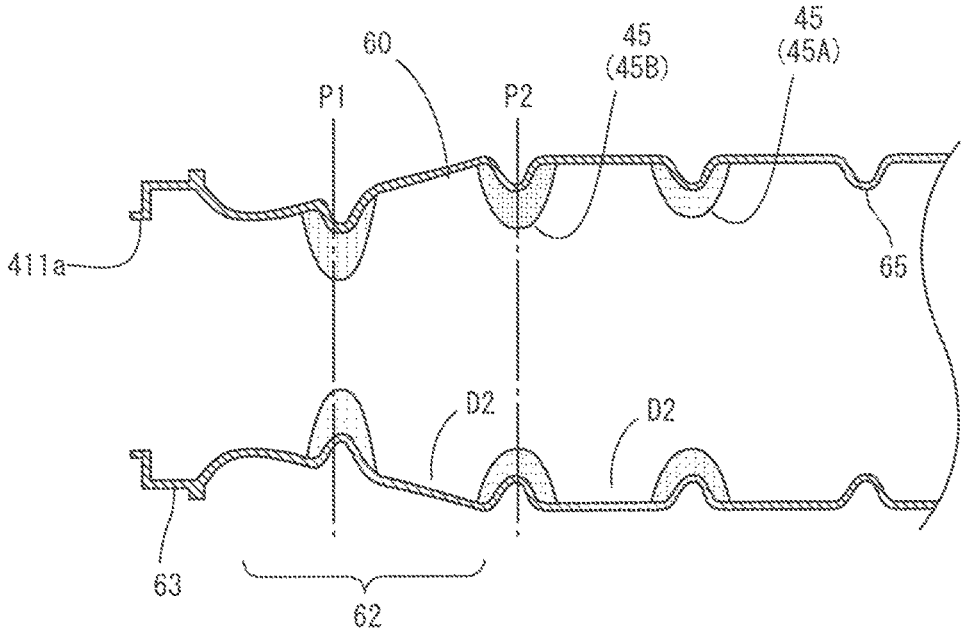
FIG. 16 is a cross-section view showing a state where the toner conveyer is attached to a container body according to a second modified example.

A toner bottle according the second modified example has a changed projection height of the toner conveyer 45. FIG. 16 is a cross-section view showing a state where the toner conveyer 45 is attached in the container body 60 according to the second modified example. End faces of the toner conveyer 45 and the container body 60 are shown in FIG. 16. Referring to FIG. 16, the toner conveyer 45 according to the second modified example is different from the examples shown in FIGS. 5 and 6 in the point where the inward projection height of the toner conveyer 45 at a first position P1 is larger than the inward projection height of the toner conveyer 45 at a second position P2 on the inner circumferential surface of the container body 60. The first position P1 is closer to the opening 411*a* than the second position P2 is. Specifically, in the taper 62, the inward projection height of the toner conveyer 45 becomes large as it approaches the opening 411*a* of the bottle portion 411.

As mentioned above, an inner diameter of the taper 62 becomes small as it approaches the opening 411*a*. Meanwhile, the groove portion D2 formed by the toner conveyer 45 has a uniform width. Therefore, if the projection height of the toner conveyer 45 is uniform, an amount of toner to be maintained in the groove is decreased as it approaches the opening 411*a*. In the third modified example, in the taper 62, the projection height of the toner conveyer 45 becomes large as it approaches the opening 411*a* of the bottle portion 411. This may equalize an amount of toner to be stored in the groove portion D2, and thus allows sufficiently securing an amount of toner conveyed by the toner conveyer 45 in a vicinity of the opening 411*a*.

<Third Modified Example>

Figure 17A:
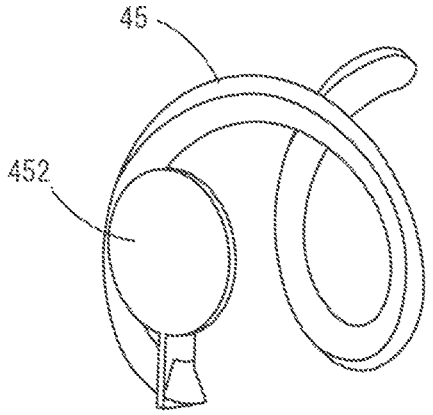
FIGS. 17A and 17B each is a diagram showing the toner conveyer and a restriction member according to a third modified example.
Figure 17B:
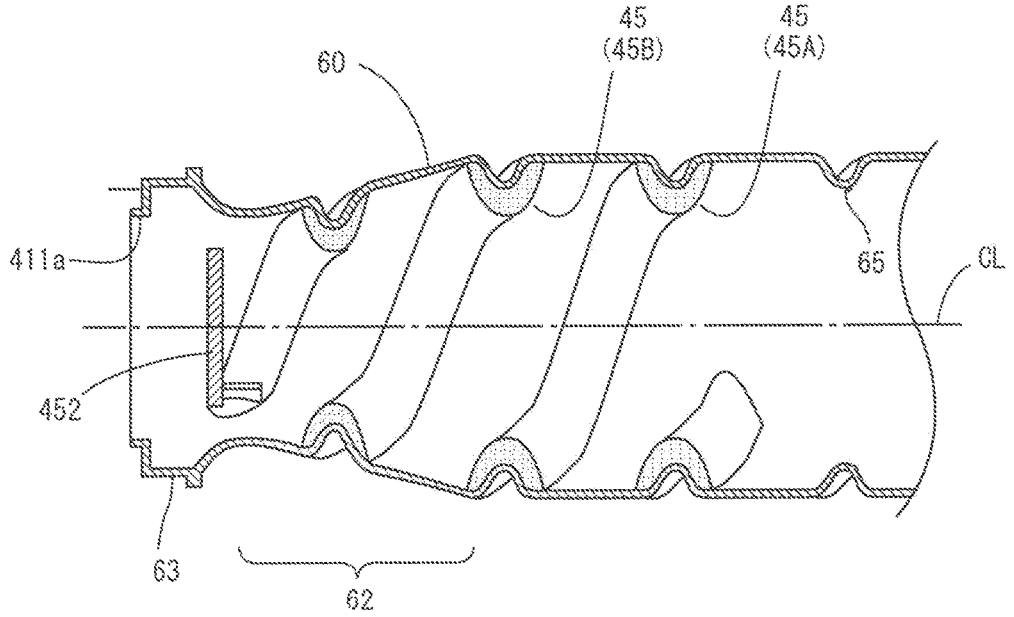

A toner bottle according to the third modified example includes a restriction member which is provided integrally with the toner conveyer 45. FIGS. 17A and 17B each is a diagram showing the toner conveyer 45 and the restriction member according to the third modified example. FIG. 17A shows an external appearances of the toner conveyer 45 and the restriction member, while FIG. 17B shows a state where the toner conveyer 45 and the restriction member are attached to the container body 60. In the FIG. 17B, the restriction member is attached to the toner conveyer 45A which is one of a pair of the toner conveyers 45A and 45B. Referring to FIGS. 17A and 17B, a restriction member 452 has a plate shape and is fixed to a front end of the toner conveyer 45. The restriction member 452 is positioned on the center line CL of the bottle portion 411 as well as substantially orthogonal to the center line CL. In this case, in a vicinity of the opening 411*a*, a streaming path of toner in the bottle portion 411 is restricted by the restriction member 452, and the flow of toner is restricted. This prevents toner, even if a large amount of toner remains in the bottle portion 411, from excessively flowing out from the opening 411*a*.

<Fourth Modified Example>

Figure 18A:
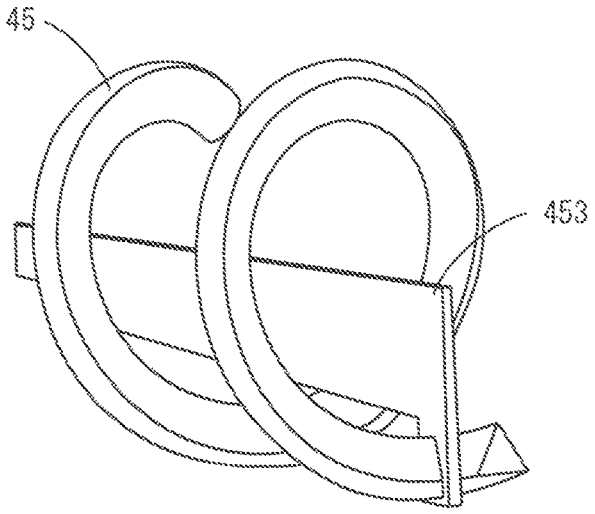
FIGS. 18A and 18B each is a diagram showing the toner conveyer and a stirring member according to a fourth modified example.
Figure 18B:
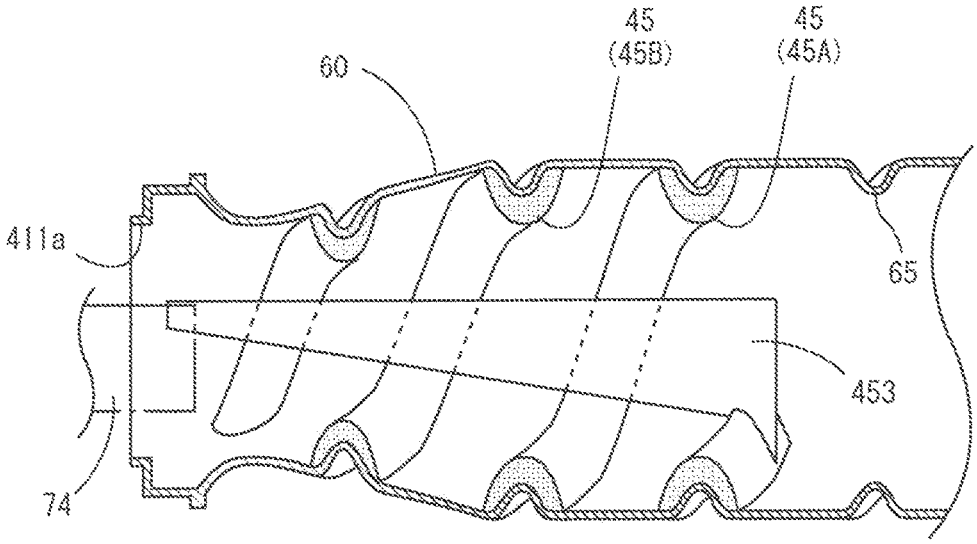

A toner bottle according to the fourth modified example includes a stirring member which is provided integrally with the toner conveyer 45. FIGS. 18A and 18B each is a diagram showing the toner conveyer 45 and the stirring member according to the fourth modified example. FIG. 18A shows external appearances of the toner conveyer 45 and the stirring member, while FIG. 18B shows a state where the toner conveyer 45 and the stirring member are attached to the container body 60. In FIG. 18B, the stirring member is attached to the toner conveyer 45B which is one of a pair of the toner conveyers 45A and 45B. Referring to FIGS. 18A and 18B, a stirring member 453 is fixed to a rear end of the toner conveyer 45 and extends forward, passing through an inner part of the toner conveyer 45. A front end of the stirring member 453 is positioned in a vicinity of the opening 411*a* of the container body 60.

When the container body 60 is rotated in the MFP 100, the stirring member 453 comes into contact with a fixing portion which is fixedly provided to the MFP 100. In the present embodiment, the stirring piece 74 of the cap portion 412 corresponds to the fixing portion which is fixedly provided to the MFP 100. The stirring member 453 includes flexibility and is deflected by coming into contact with the stirring piece 74. Further, when the stirring member 453 in a state of being deflected is separated from the stirring piece 74, the stirring member 453 begins to swing by the restoring force applying to the stirring member 453. In this case, the toner collected in a vicinity of the opening 411*a* of the bottle portion 411 is stirred by the stirring member 453. Therefore, this prevents toner in a flocculated state from flowing out of the opening 411*a*, and it is possible to stably adjust a supplied amount of toner from the opening 411*a*.

A shape of the stirring member 453 is not especially limited. FIGS. 18A and 18B each shows that the stirring member 453 has a plate shape, but it may have a bar-shape or a curved shape. Further, the stirring member 453 may extend to backward position of a rear end of the toner conveyer 45. Further, the number of the stirring member 453 is not limited to one, and more than two of the stirring member 453 may be attached to either one or a pair of the toner conveyer 45.

<Fifth Modified Example>

Figure 19:
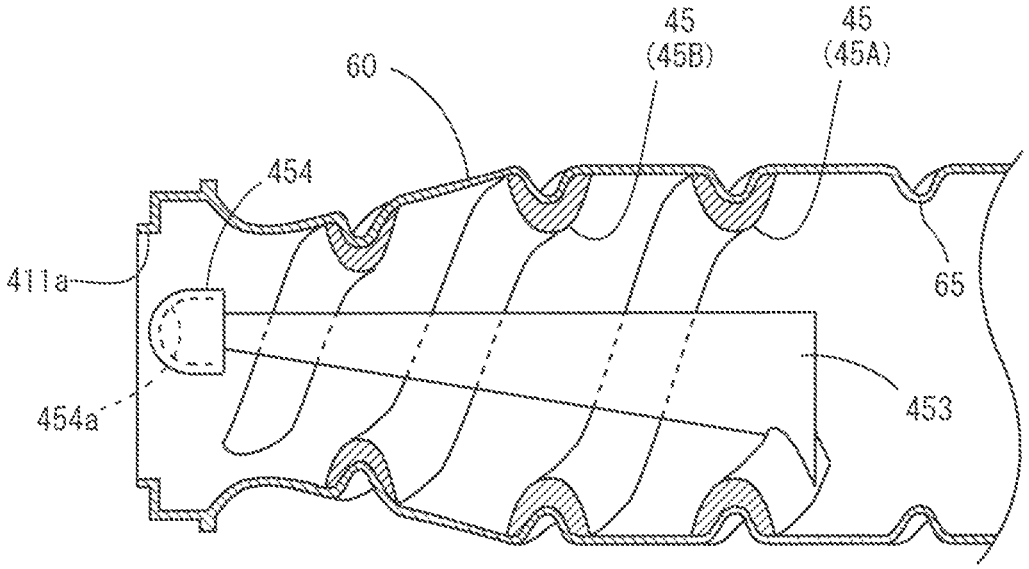
FIG. 19 is a diagram showing the toner conveyer, the stirring member and a containing member according to a fifth modified example.

A toner bottle according to the fifth modified example further includes a containing member in addition to the stirring member 453. FIG. 19 is a cross-section view showing a state where the toner conveyer 45, the stirring member 453 and the containing member are attached to the container body 60 according to the fifth modified example. In FIG. 19, the stirring member 453 and the containing member are attached to the toner conveyer 45B which is one of a pair of the toner conveyers 45A and 45B. Referring to FIG. 19, a containing member 454 is fixed to a front end of the stirring member 453. The containing member 454 includes a containing area 454*a* capable of storing toner, and is opened backward. If a large amount of toner remains in the bottle portion 411, a part of toner conveyed toward the opening 411*a* flows into the containing member 454. If an amount of toner in the bottle portion 411 is decreased, toner flows out of the containing member 454 along with the swinging of the stirring member 453, and the toner flowed out is conveyed by the toner conveyer 45. This allows securing the amount of toner conveyed even if an amount of toner in the bottle portion 411 is decreased, and this makes it possible to stably supply toner from the bottle portion 411. It should be noted that, the number of the containing member 454 is not limited one, but more than two of the containing member 454 may be provided. In this case, a plurality of the containing member 454 may be fixed to one of the stirring member 453, while a plurality of the stirring member 453 may be provided, and the containing member 454 may be fixed to each of the plurality of the stirring member 453.

<Sixth Modified Example>

Figure 20A:
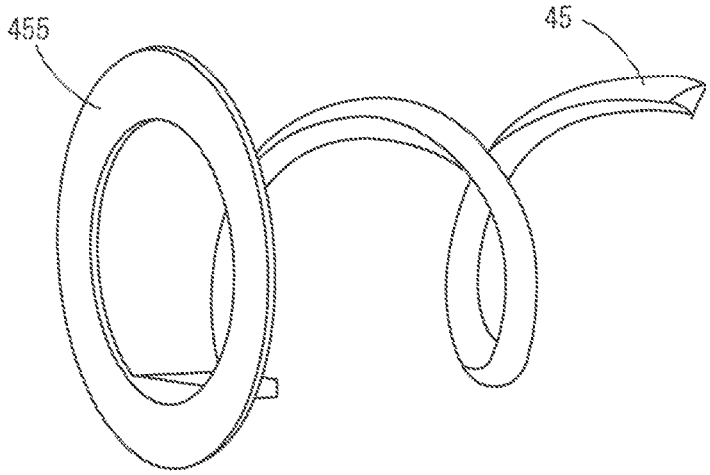
FIGS. 20A and 20B each is a diagram showing the toner conveyer and a locking member according to a sixth modified example.
Figure 20B:
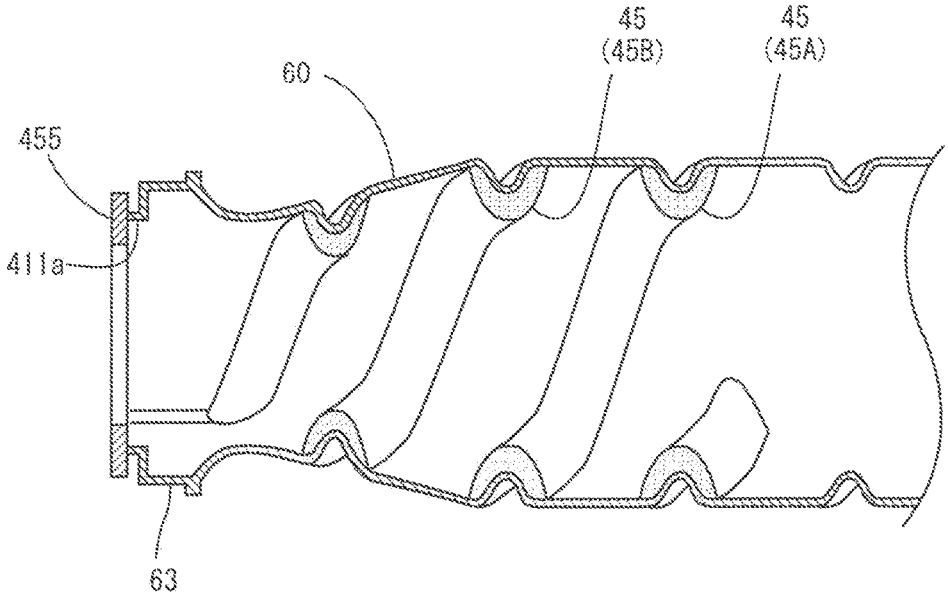

A toner bottle according to the sixth modified example includes a locking member which is provided integrally with the toner conveyer 45. FIGS. 20A and 20B each is a diagram showing the toner conveyer 45 and the locking member according to the sixth modified example. FIG. 20A shows external appearances of the toner conveyer 45 and the locking member, while FIG. 20B shows a state where the toner conveyer 45 and the locking member are attached to the container body 60. In FIG. 20B, the locking member is attached to the toner conveyer 45A which is one of a pair of the toner conveyers 45A and 45B. Referring to FIGS. 20A and 20B, a locking member 455 has an annular shape and is fixed to a front end of the toner conveyer 45. When the toner conveyer 45 is attached to the container body 60, the locking member 455 is locked at an edge of the opening 411*a* (a front end of the cap attaching portion 63) of the container body 60. This prevents the toner conveyer 45 to be inserted more backward than a predetermined position, and positioning of the toner conveyer 45 is facilitated. The locking member 455 according to the sixth modified example is an example of a positioner for positioning the toner conveyer 45 in the container body 60. It should be note that, a shape of the locking member 455 is not limited to an annular shape, but may be another shape as long as the locking member can be locked at an edge of the opening 411*a*.

Figure 21A:
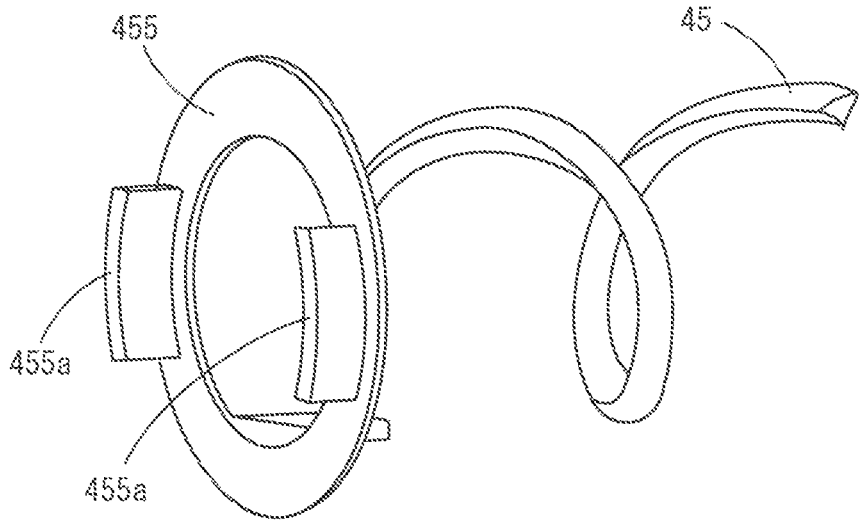
FIGS. 21A and 21B each is a perspective view showing a further modified example of the sixth modified example.
Figure 21B:
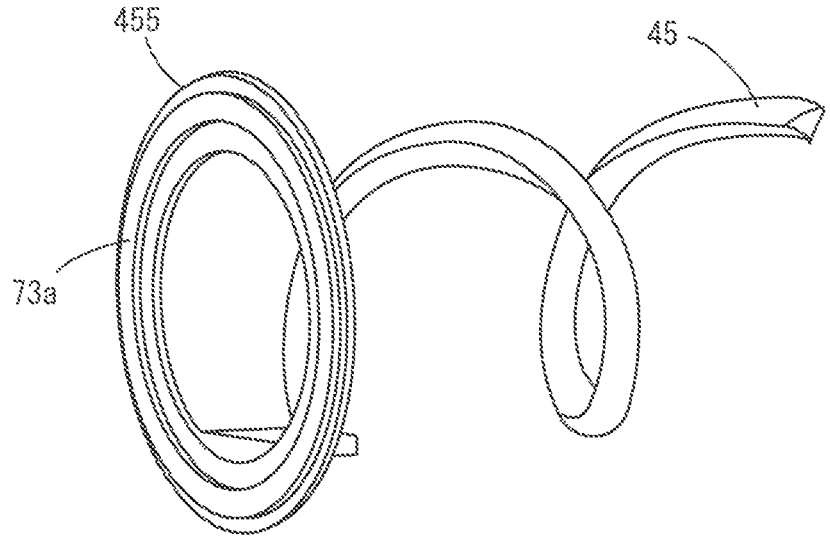

FIGS. 21A and 21B each is a perspective view showing a further modified example of the sixth modified example. According to the example shown in FIG. 21A, a pair of a gripping portion 455*a* is provided on a front surface of the locking member 455. In this case, it is possible to attach the toner conveyer 45 to the container body 60 while gripping the gripping portion 455*a*. According to the example shown in FIG. 21B, a sealing member 73*a* is attached to a front surface of the locking member 455. The sealing member 73*a* is a substitute for the sealing member 73 provided to the cap portion 412 (in FIG. 10). When the cap portion 412 is attached to the bottle portion 411, the circumferential edge sealing portion 71*a* of the cap portion 412 (in FIG. 10) closely adheres to the sealing member 73*a*, and thus the opening 411*a* of the bottle portion 411 is locked.

<Seventh Modified Example>

Figure 22:
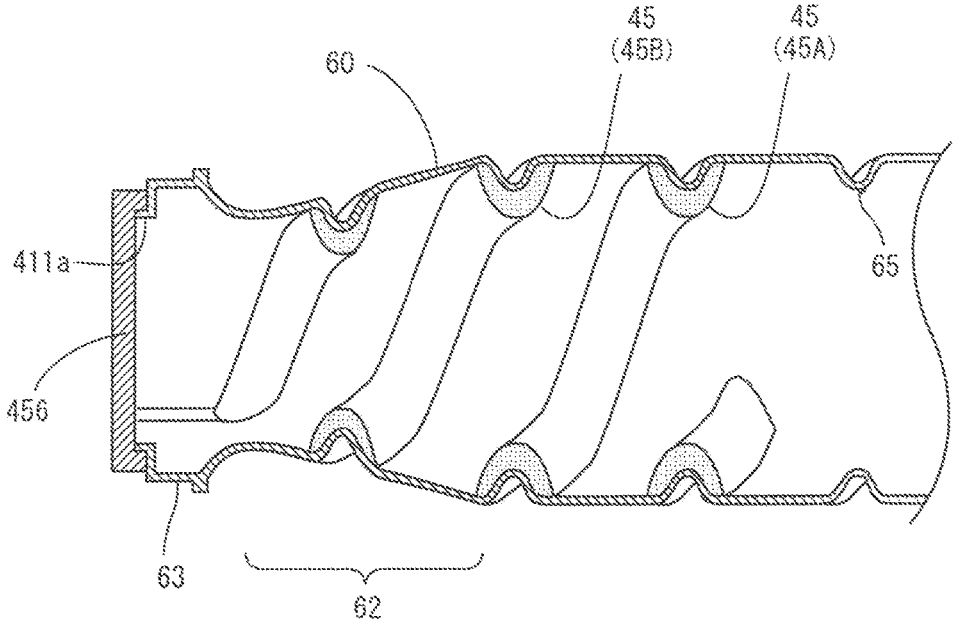
FIG. 22 is a diagram showing the toner conveyer and a shutting member according to a seventh modified example.

A toner bottle according to the seventh modified example includes a shutting member which is provided integrally with the toner conveyer 45. FIG. 22 is a cross-section view showing a state where the toner conveyer 45 and the shutting member are attached to the container body 60 according to the seventh modified example. In FIG. 22, the shutting member is attached to the toner conveyer 45A which is one of a pair of the toner conveyers 45A and 45B. Referring to FIG. 22, a shutting member 456 is provided attachable to and detachable from a front end of the toner conveyer 45. The shutting member 456 functions as a substitute for the cap portion 412, and shuts the opening 411*a* of the container body 60 so as to prevent toner from flowing out from the container body 60. The container body 60 is attached to the MFP 100 in the state where the opening 411*a* is shut by the shutting member 456. A fixing portion to fix the shutting member 456 is provided to the MFP 100. When the container body 60 is rotated in the MFP 100, the shutting member 456 releases the opening 411*a*, while the toner conveyer 45 is removed from the shutting member 456 to be rotated with the container body 60. This makes it easy to configure the toner bottle in comparison with the case where the cap portion 412 is attached.

<Eighth Modified Example>

Figure 23:
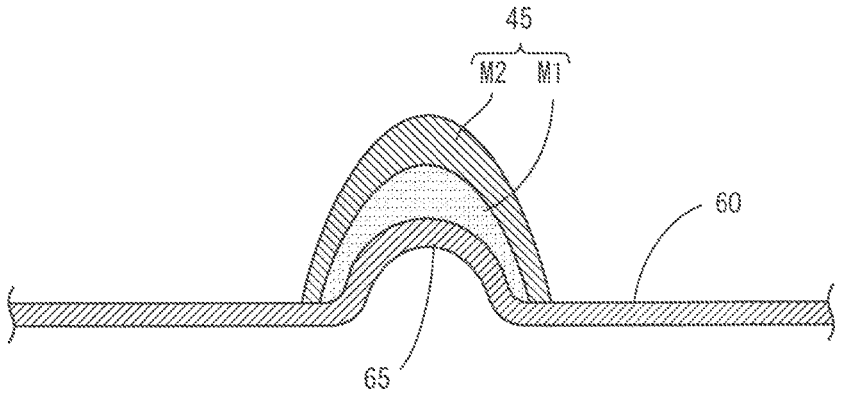
FIG. 23 is a cross-section view of the toner conveyer according to an eighth modified example.

A toner bottle according to the eighth modified example includes the toner conveyer 45 which is made from not only a single material but from a plurality of materials. FIG. 23 is a cross-section view of the toner conveyer 45 according to the eighth modified example. Referring to FIG. 23, the toner conveyer 45 according the eighth modified example is different from the examples shown in FIGS. 5 and 6 in the point where the toner conveyer 45 is formed of two layers of a soft material M1 which is relatively low in hardness, and a hard material M2 which is relatively high in hardness. The soft material M1 covers a surface of the projection 65 of the container body 60, while the hard material M2 covers a surface of the soft material M1. The soft material M1 is made from, for example, polyurethane, while the hard material M2 is made from, for example, polyethylene terephthalate (PET). In this case, it is possible to enhance adhesion between the toner conveyer 45 and the container body 60 by using the soft material M1. Further, it is possible to enhance processing accuracy of the toner conveyer 45 by using the hard material M2. It should be noted that, the toner conveyer 45 may be formed of, not only two layers but also more than three layers. Further, the toner conveyer 45 may be made from a plurality of materials having different characteristics other than hardness (for example, surface roughness).

<Ninth Modified Example>

Figure 24:
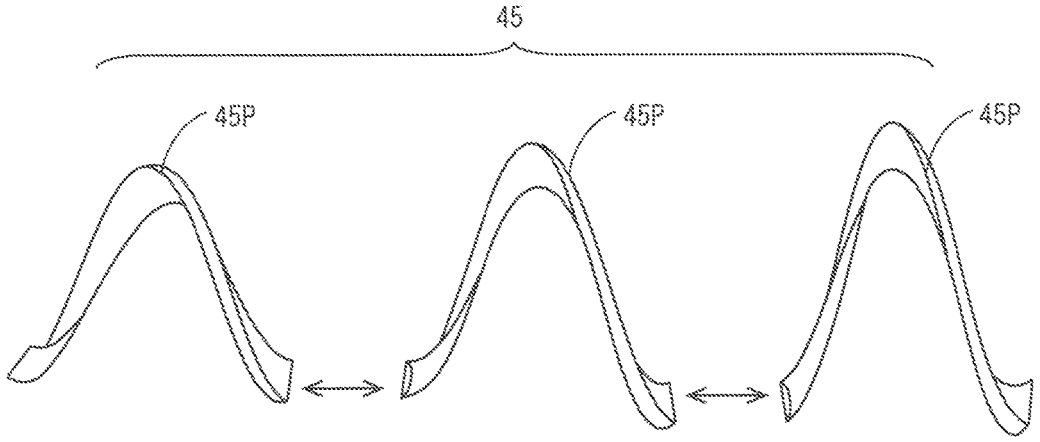
FIG. 24 is a side view of the toner conveyer according to a ninth modified example.

A toner bottle according to the ninth modified example includes the toner conveyer 45 which is able to be separated into a plurality of parts. FIG. 24 is a side view of the toner conveyer 45 according to the ninth modified example. Referring to FIG. 24, the toner conveyer 45 according to the ninth modified example is different from the examples shown in FIGS. 5 and 6 in the point where the toner conveyer 45 includes a plurality (three in the present embodiment) of a conveying part 45P. The plurality of the conveying part 45P are connected to each other by a fitting structure, a locking structure and so on. In this case, the number of the conveying part 45P to be connected is changed, and this makes it possible to adjust a length in the forward and backward directions of the toner conveyer 45. Further, it is possible to connect a member having other functions to the toner conveyer 45.

<Tenth Modified Example>

Figure 25:
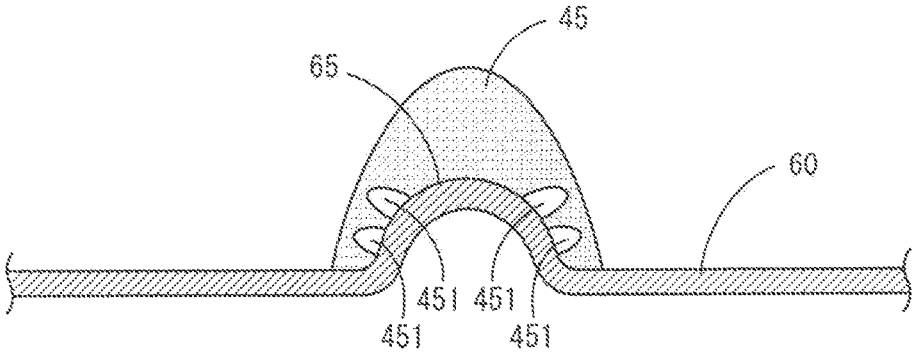
FIG. 25 is a cross-section view of the toner conveyer according to a tenth modified example.

A toner bottle according to the tenth modified example includes the toner conveyer 45 of which a cross-section shape is changed. FIG. 25 is a cross-section view of the toner conveyer 45 according to the tenth modified example. Referring to FIG. 25, the toner conveyer 45 according to the tenth modified example is different from the examples shown in FIGS. 5 and 6 in the point where a plurality of a recessed portion 451 are further formed on an inner surface of the recessed portion 45*a*. Specifically, a pair of the recessed portion 451 is formed on a position of the inner surface on a one side of portions sandwiching the projection 65 of the container body 60, while on a position of the inner surface on the other side of the portion, a pair of the recessed portion 451 is formed. In this case, a contact resistance is reduced between the toner conveyer 45 and the projection 65 of the container body 60, and this makes it easy to attach the toner conveyer 45 to the projection 65. Further, since a volume of the toner conveyer 45 becomes small, it is possible to realize a light weight of the toner conveyer 45 as well as to reduce material costs of the toner conveyer 45.

<Eleventh Modified Example>

Figure 26:
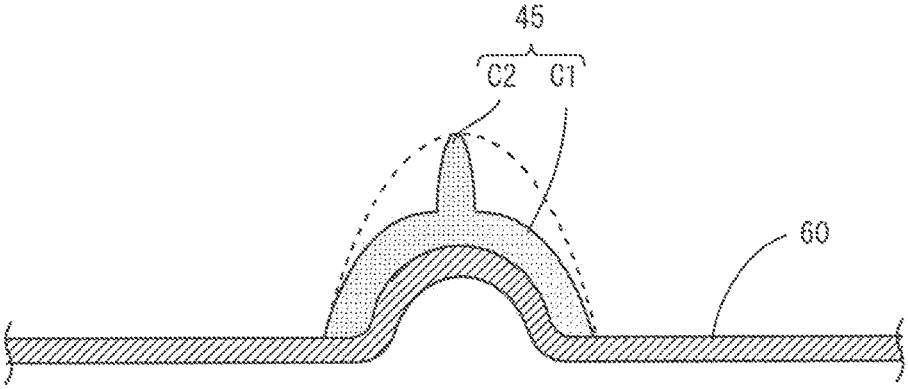
FIG. 26 is a cross-section view of the toner conveyer according to an eleventh modified example.

A toner bottle according to the eleventh modified example includes the toner conveyer 45 of which a cross-section shape is changed. FIG. 26 is a cross-section view of the toner conveyer 45 according to the eleventh modified example. FIG. 26 shows as a reference by a dotted line a cross-section of the toner conveyer 45 shown in FIGS. 5 and 6. Referring to FIG. 26, the toner conveyer 45 according to the eleventh modified example is different from the examples shown in FIGS. 5 and 6 in the point where a width of the toner conveyer 45 gradually becomes small toward inside (toward upward in FIG. 26). Specifically, the toner conveyer 45 includes a base portion C1 and a projecting portion C2. The base portion C1 has a uniform thickness, while the projecting portion C2 extends toward inside in a projecting shape from an inner end of the base portion C1. Curvature of a surface of the projecting portion C2 is larger than curvature of a surface of the base portion C1. Likewise, since a width of the toner conveyer 45 gradually becomes small toward inside, an amount of toner which can be maintained in the groove portion D2 formed by the toner conveyer 45 (in FIG. 11) is increased. Therefore, it is possible to stably supply toner from the bottle portion 411.

<Other Modified Example>

More than two of characteristic features included in above first through eleventh modified examples may be combined. For example, characteristic features for positioning the toner conveyer 45 as included in the first modified example may apply to any other modified examples. Further, a projection height of the toner conveyer 45 as a characteristic feature included in the second modified example may apply to any other modified examples. Furthermore, the restriction member 452 described in the third modified example, the stirring member 453 described in the fourth modified example, the containing member 454 described in the fifth modified example, the locking member 455 described in the sixth modified example and the shutting member 456 described in the seventh modified example may be combined as appropriate for use to each other. Furthermore, characteristic features included in the eighth through eleventh modified examples may apply to any other modified examples.

<Second Embodiment>

Figure 27:
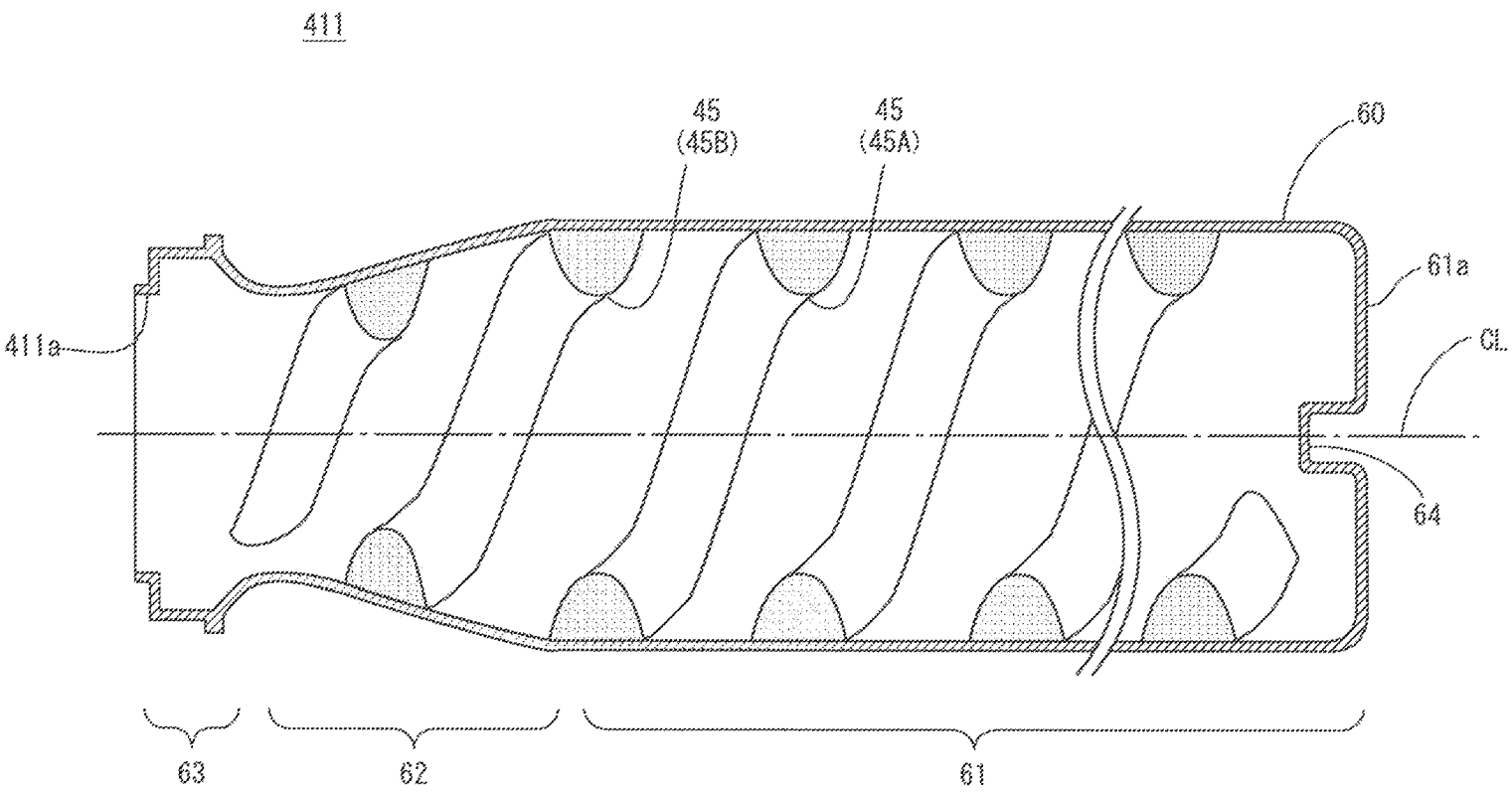
FIG. 27 is a cross-section view of the bottle portion included in the toner bottle according to a second embodiment.

FIG. 27 is a cross-section view of the bottle portion 411 included in the toner bottle according to the second embodiment. Referring to FIG. 27, the bottle portion 411 according to the second embodiment is different from the example shown in FIG. 5 in the point where the projection 65 is not provided to the container body 60, the toner conveyer 45 (45A and 45B) extends into a vicinity of the bottom portion 61*a* of the container body 60, and the recessed portion 45*a* is not provided to the toner conveyer 45.

In this case, since the projection 65 is not provided to the container body 60, molding of the container body 60 is facilitated. Further, since the toner conveyer 45 extends into a vicinity of the bottom portion 61*a* of the container body 60, toner in the bottle portion 411 is conveyed forward to the opening 411*a* by the toner conveyer 45 in response to an event that the bottle portion 411 is rotated.

Further, since the toner conveyer 45 is provided separately from the container body 60, a size of the toner conveyer 45 can be adjusted at a high degree of freedom. Therefore, it is possible to readily enlarge an inward projection height of the toner conveyer 45, and thus enhance the conveying efficiency of toner in the container body 60. As a result, it enables toner to stably flow out from the bottle portion 411 to be stably supplied to the MFP 100.

In the present embodiment mentioned above, the MFP 100 has been described as an example of an image forming apparatus, however, other than the MFP 100, it may be a printer or a facsimile apparatus capable of forming an image by using toner.

Although embodiments of the present invention have been described and illustrated in detail, it is clearly understood that the same is by way of illustration and example only and not limitation, the scope of the present invention should be interpreted by the terms of the appended claims.

What is claimed is:

1. A toner storing container configured to store toner and to be attachable to and detachable from an image forming apparatus, the toner storing container comprising:

a container body that includes an opening, an inner circumferential surface, and a projection that projects inward from the inner circumferential surface, the inner circumferential surface extending toward the opening around a center line extending in one direction, and the projection spirally extending in the one direction around the center line; and a toner conveyer that is attached onto the inner circumferential surface of the container body, the toner conveyer projecting inward from the inner circumferential surface and spirally extending in the one direction around the center line, and the toner conveyer being attached to the container body so as to cover at least a part of the projection.

2. The toner storing container according to claim 1, wherein the container body includes a taper that extends in the one direction and gradually decreases in diameter toward the opening.

3. The toner storing container according to claim 1, wherein at least one of the container body and the toner conveyer includes a positioner for positioning the toner conveyer with respect to the container body.

4. The toner storing container according to claim 1, wherein the toner conveyer has flexibility.

5. The toner storing container according to claim 1, wherein a height of an inward projection of the toner conveyer at a first position of the inner circumferential surface is larger than a height of an inward projection of the toner conveyer at a second position of the inner circumferential surface, and wherein the first position is closer to the opening than the second position is.

6. The toner storing container according to claim 1, further comprising a restriction member that is provided integrally with the toner conveyer so as to be positioned on the center line.

7. The toner storing container according to claim 1, further comprising a stirring member that is provided integrally with the toner conveyer so as to extend in the one direction inside the toner conveyer, wherein the stirring member is deflected by coming into contact with a fixing portion that is fixedly provided to the image forming apparatus when the container body is rotated inside the image forming apparatus.

8. An image forming apparatus comprising the toner storing container according to claim 1.

9. A method for manufacturing a toner storing container that is configured to store toner and that is attachable to and detachable from an image forming apparatus, the method comprising:

an attaching step of attaching a toner conveyer onto a container body, wherein the container body includes an opening, an inner circumferential surface extending toward the opening around a center line extending in one direction, and a projection that projects inward from the inner circumferential surface and spirally extends in the one direction around the center line, and wherein the toner conveyer is attached onto the inner circumferential surface of the container body so as to cover at least a part of the projection and so as to project inward from the inner circumferential surface of the container body and spirally extend in the one direction around the center line; and a filling step of filling toner into the container body.

10. The method according to claim 9, wherein the filling step is performed before the attaching step.

11. The method according to claim 9, wherein the filling step is performed after the attaching step.

12. The method according to claim 9, wherein the container body includes a taper that extends in the one direction and gradually decreases in diameter toward the opening.

13. The method according to claim 9, wherein at least one of the container body and the toner conveyer includes a positioner for positioning the toner conveyer with respect to the container body.

14. The method according to claim 9, wherein the toner conveyer has flexibility.

15. The method according to claim 9, wherein a height of an inward projection of the toner conveyer at a first position of the inner circumferential surface is larger than a height of an inward projection of the toner conveyer at a second position of the inner circumferential surface, and wherein the first position is closer to the opening than the second position is.

16. The method according to claim 9, wherein a restriction member is provided integrally with the toner conveyer so as to be positioned on the center line.

17. The method according to claim 9, wherein a stirring member is provided integrally with the toner conveyer so as to extend in the one direction inside the toner conveyer, and wherein when the container body is rotated inside the image forming apparatus, the stirring member is deflected by coming into contact with a fixing portion that is fixedly provided to the image forming apparatus.

18. A toner storing container configured to store toner and to be attachable to and detachable from an image forming apparatus, the toner storing container comprising:

a container body that includes an opening, and an inner circumferential surface extending toward the opening around a center line extending in one direction; and a toner conveyer that is attached onto the inner circumferential surface of the container body, wherein the toner conveyer projects inward from the inner circumferential surface and spirally extends in the one direction around the center line, and wherein at least one of the container body and the toner conveyer includes a positioner for positioning the toner conveyer with respect to the container body.

* * * * *